US008210154B2

(12) United States Patent
Nakamura et al.

(10) Patent No.: US 8,210,154 B2
(45) Date of Patent: Jul. 3, 2012

(54) VARIABLE VALVE ACTUATION APPARATUS OF INTERNAL COMBUSTION ENGINE

(75) Inventors: Makoto Nakamura, Isehara (JP); Masahiro Shoji, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 323 days.

(21) Appl. No.: 12/615,560

(22) Filed: Nov. 10, 2009

(65) Prior Publication Data

US 2010/0186695 A1 Jul. 29, 2010

(30) Foreign Application Priority Data

Jan. 23, 2009 (JP) ..... 2009-012695

(51) Int. Cl.
*F02D 13/00* (2006.01)
*F02D 13/02* (2006.01)

(52) U.S. Cl. ..... 123/348; 123/90.16

(58) Field of Classification Search ..... 123/90.16, 123/90.17, 90.18, 90.25, 90.26, 90.31, 90.6, 123/345, 346, 347, 348; 74/567; 251/251
See application file for complete search history.

(56) References Cited

U.S. PATENT DOCUMENTS 5,647,310 A * 7/1997 Kimura ..... 123/90.6
6,138,627 A * 10/2000 Iida ..... 123/90.6
6,550,437 B2 4/2003 Nakamura et al.
7,246,578 B2 * 7/2007 Nakamura et al. ..... 123/90.16
2002/0117134 A1 8/2002 Nakamura et al.

FOREIGN PATENT DOCUMENTS

JP 2002-256832 A 9/2002
JP 2006-307658 A 11/2006

* cited by examiner

*Primary Examiner* — Mahmoud Gimie
(74) *Attorney, Agent, or Firm* — Foley & Lardner LLP

(57) ABSTRACT

In a variable valve actuation apparatus of an internal combustion engine configured to variably control at least a working angle of an engine valve, a valve actuation mechanism is configured to control a valve acceleration characteristic of the engine valve depending on an engine operating condition. The valve actuation mechanism is configured to bring about a first state where a maximum positive valve-closing acceleration of the engine valve becomes less than a maximum positive valve-opening acceleration of the engine valve, at a maximum working angle. The valve actuation mechanism is further configured so that a second state where the maximum positive valve-opening acceleration of the engine valve becomes less than the maximum positive valve-closing acceleration of the engine valve, exists at a working angle less than the maximum working angle.

20 Claims, 12 Drawing Sheets

VARIABLE VALVE ACTUATION APPARATUS OF INTERNAL COMBUSTION ENGINE

TECHNICAL FIELD

The present invention relates to a variable valve actuation apparatus of an internal combustion engine, capable of varying at least a working angle (a valve open period) of an engine valve depending on an engine operating condition.

BACKGROUND ART

As is generally known, in recent years there have been proposed and developed various variable valve actuation devices, in which a working angle of an engine valve (an intake valve and/or an exhaust valve) can be variably controlled depending on an engine operating condition, in order to ensure improved fuel economy and stable driveability (improved operational stability of the engine or stable engine speeds) during low-speed and low-load operation and also to ensure a sufficient engine power output caused by an enhanced intake-air charging efficiency during high-speed and high-load operation. One such variable valve actuation device has been disclosed in Japanese Patent Provisional Publication No. 2002-256832 (hereinafter is referred to as "JP2002-256832"), corresponding to U.S. Pat. No. 6,550,437, issued on Apr. 22, 2003 and assigned to the assignee of the present invention. The variable valve actuation device disclosed in JP2002-256832, often called "continuous variable valve event and lift control (VEL) system", is configured to adjust an angle of oscillation of a rockable cam by varying a fulcrum of oscillating motion of a rocker arm by rotary motion of a control cam attached to the outer periphery of a control shaft, thereby variably controlling a valve lift and a working angle of an intake valve. Additionally, the variable valve actuation device disclosed in JP2002-256832 has an intake-valve lift characteristic that a maximum positive acceleration of the valve lift increasing side (that is, a maximum positive valve opening acceleration) is set to be greater than a maximum positive acceleration of the valve lift decreasing side (that is, a maximum positive valve closing acceleration), regardless of the magnitude of working angle of the intake valve. In other words, regarding each and every working angle of the intake valve, the variable valve actuation device of JP2002-256832 has a so-called "forwardly-inclined unsymmetrical valve lift characteristic" in which the intake-valve lift characteristic curve is slightly inclined forwards (see FIG. 3A of U.S. Pat. No. 6,550,437). For instance when the intake valve has been controlled to a maximum working angle in a high-speed range, by virtue of such a "forwardly-inclined unsymmetrical valve lift characteristic", it is possible to suppress an abnormally re-seating behavior (that is, "jumping" or "valve bounce" phenomenon) of the intake valve in the last stage of valve-closing motion, thus suppressing an excessive load (e.g., an impact load) from being undesirably applied to the valve actuation mechanism, in other words, an undesirable deformation of the valve actuation mechanism.

SUMMARY OF THE INVENTION

However, in the variable valve actuation device of JP2002-256832, the maximum positive valve opening acceleration is set to be greater than the maximum positive valve closing acceleration, regardless of the magnitude of working angle of the intake valve. Owing to such settings of the maximum positive valve opening acceleration and the maximum positive valve closing acceleration, a driving friction tends to increase in a middle working-angle range (i.e., in a normal operating range) or in a small working-angle range (i.e., during an engine starting period). This leads not only to deteriorated fuel economy, but also to lowered engine startability.

It is, therefore, in view of the previously-described disadvantages of the prior art, an object of the invention to provide a variable valve actuation apparatus configured to achieve enhanced engine startability as well as reduced driving torque and driving friction in a small- and middle-working-angle range, while suppressing an abnormally re-seating behavior (i.e., undesirable "jumping" or "valve bounce" phenomenon) of an engine valve in the last stage of valve-closing motion especially in a large working-angle range.

In order to accomplish the aforementioned and other objects of the present invention, a variable valve actuation apparatus of an internal combustion engine configured to variably control at least a working angle of an engine valve, comprises a device configured to control a valve acceleration characteristic of the engine valve depending on an engine operating condition, the device configured to bring about a first state where a maximum positive valve-closing acceleration of the engine valve becomes less than a maximum positive valve-opening acceleration of the engine valve, at a maximum working angle, and the device configured so that a second state where the maximum positive valve-opening acceleration of the engine valve becomes less than the maximum positive valve-closing acceleration of the engine valve, exists at a working angle less than the maximum working angle.

According to another aspect of the invention, a variable valve actuation apparatus of an internal combustion engine configured to variably control at least a working angle of an engine valve, comprises a device configured to control a lift characteristic of the engine valve depending on an engine operating condition, the device configured to bring about a fifth state where a valve-closing working angle after a peak lift of a cam lift curve of a cam provided for operating the engine valve becomes greater than a valve-opening working angle before the peak lift of the cam lift curve, at a maximum working angle, and the device configured so that a sixth state where the valve-opening working angle of the cam lift curve becomes greater than the valve-closing working angle of the cam lift curve, exists at a working angle less than the maximum working angle.

According to a further aspect of the invention, a variable valve actuation apparatus of an internal combustion engine configured to variably control at least a working angle of an engine valve, comprises a multinodular-link mechanism comprising a drive cam adapted to be mechanically linked to an engine crankshaft, so that torque from the crankshaft is transmitted to the drive cam, a control shaft having a control eccentric shaft whose geometric center is varied by rotating the control shaft, a rocker arm adapted to be pivotably supported on the control eccentric shaft, a link arm adapted to be pivotably supported on the drive cam and linked to the rocker arm, for converting rotary motion of the drive cam into oscillating motion of the rocker arm, and a rockable cam adapted to be linked to the rocker arm, for actuating the engine valve by transmitting an oscillating force of the rocker arm to the rockable cam, the multinodular-link mechanism configured to change the working angle of the engine valve by rotating the control shaft, the multinodular-link mechanism configured to produce a linkage attitude change that an angle between a first line segment interconnecting a rotation center of the drive cam and a connecting point of the link arm and the rocker arm and a second line segment interconnecting the connecting point of the link arm and the rocker arm and a geometric center of the control eccentric shaft becomes greater than 90 degrees at either a valve-opening working angle starting point or a valve-closing working angle end point under a state where the control shaft has been rotated to change the working angle of the engine valve to a maximum working angle, and the multinodular-link mechanism configured to produce a linkage attitude change that the angle between the first line segment and the second line segment becomes less than 90 degrees at either the valve-opening working angle starting point or the valve-closing working angle end point under a state where the control shaft has been rotated in a direction for decreasing of the working angle of the engine valve from the maximum working angle.

According to a still further aspect of the invention, a variable valve actuation apparatus of an internal combustion engine configured to variably control at least a working angle of an engine valve, comprises a multiple-cam valve actuation mechanism comprising a plurality of cams having respective specific cam profiles differing from each other, and a switching mechanism configured to carry out switching of the cams with respect to the engine valve, for changing the working angle of the engine valve by the specific cam profile of a selected one of the cams, wherein a maximum-working-angle cam of the cams is configured to produce a maximum working angle and has the specific cam profile that an inclination angle of a former-half maximum-working-angle cam-contour surface section, ranging from a first base-circle surface to a first lift surface to produce opening-motion of the engine valve, is set to be greater than an inclination angle of a latter-half maximum-working-angle cam-contour surface section, ranging from the first lift surface to the first base-circle surface to produce closing-motion of the engine valve, and wherein at least one of the cams except the maximum-working-angle cam is configured to produce a relatively small working angle less than the maximum working angle and has the specific cam profile that an inclination angle of a former-half relatively-small-working-angle cam-contour surface section, ranging from a second base-circle surface to a second lift surface to produce opening-motion of the engine valve, is set to be less than an inclination angle of a latter-half relatively-small-working-angle cam-contour surface section, ranging from the second lift surface to the second base-circle surface to produce closing-motion of the engine valve.

The other objects and features of this invention will become understood from the following description with reference to the accompanying drawings.

BRIEF DESCRIPTION OF THE DRAWINGS

FIG. 3A is a plan view of a rocker arm included in a multinodular-link motion transmission mechanism of the apparatus of the first embodiment, whereas

FIG. 4A is a side view of the multinodular-link motion transmission mechanism in partial cross-section taken along the line A-A of FIG. 2 during a valve closing period at a minimum working-angle control mode, whereas

FIG. 5A is a side view of the multinodular-link motion transmission mechanism in partial cross-section taken along the line A-A of FIG. 2 at the peak lift (at the maximum valve lift) during a valve opening period at the minimum working-angle control mode, whereas

FIG. 6A is a side view of the multinodular-link motion transmission mechanism in partial cross-section taken along the line A-A of FIG. 2 during the valve closing period at a middle working-angle control mode, whereas

FIG. 7A is a side view of the multinodular-link motion transmission mechanism in partial cross-section taken along the line A-A of FIG. 2 at the peak lift during the valve opening period at the middle working-angle control mode, whereas

FIG. 8A is a side view of the multinodular-link motion transmission mechanism in partial cross-section taken along the line A-A of FIG. 2 during the valve closing period at a maximum working-angle control mode, whereas

FIG. 9A is a side view of the multinodular-link motion transmission mechanism in partial cross-section taken along the line A-A of FIG. 2 at the peak lift during the valve opening period at the maximum working-angle control mode, whereas

DESCRIPTION OF THE PREFERRED EMBODIMENTS

First Embodiment

Figure 1:
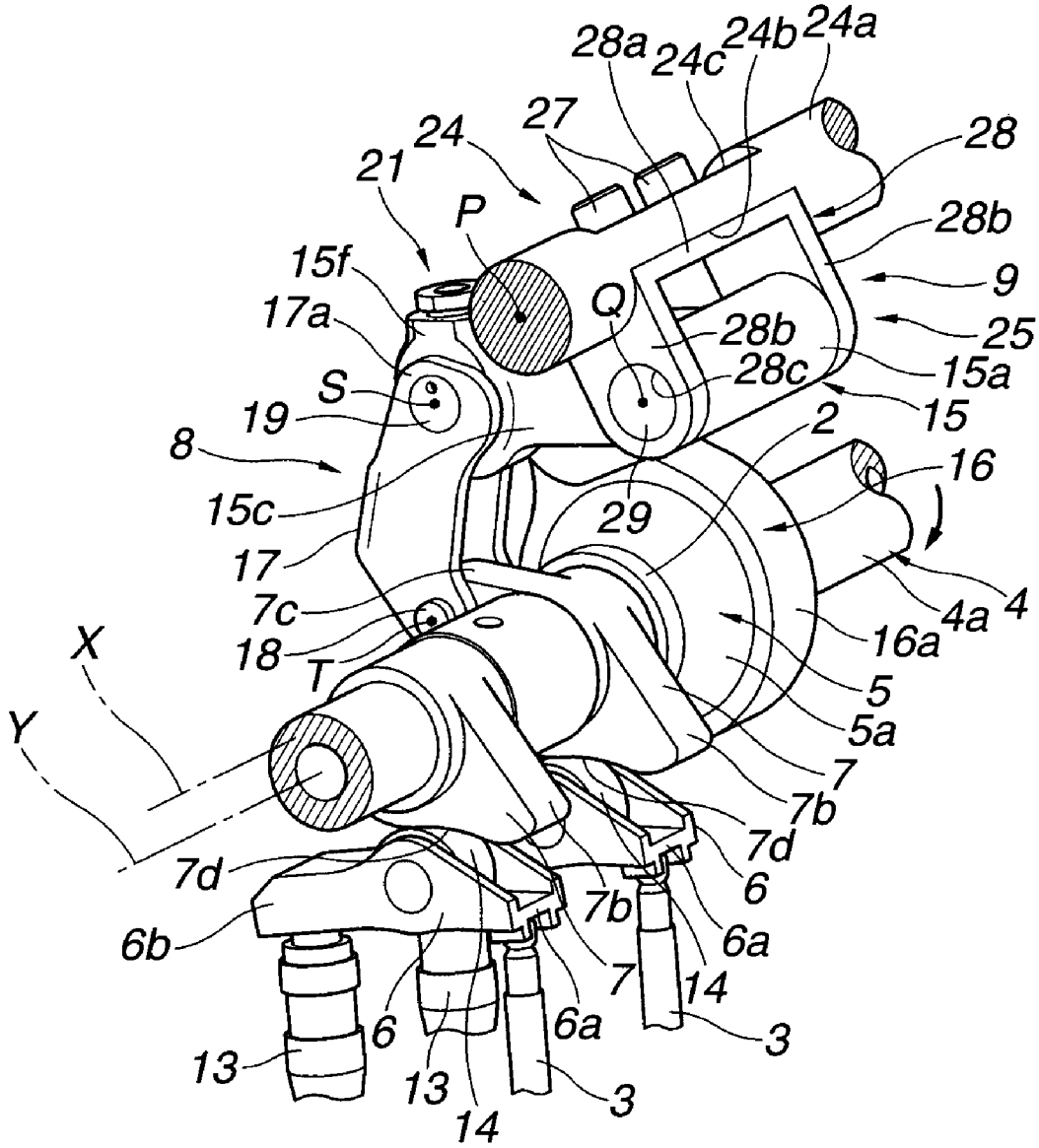
FIG. 1 is a perspective view illustrating a first embodiment of a variable valve actuation apparatus, highlighting the essential part of the apparatus.
Figure 2:
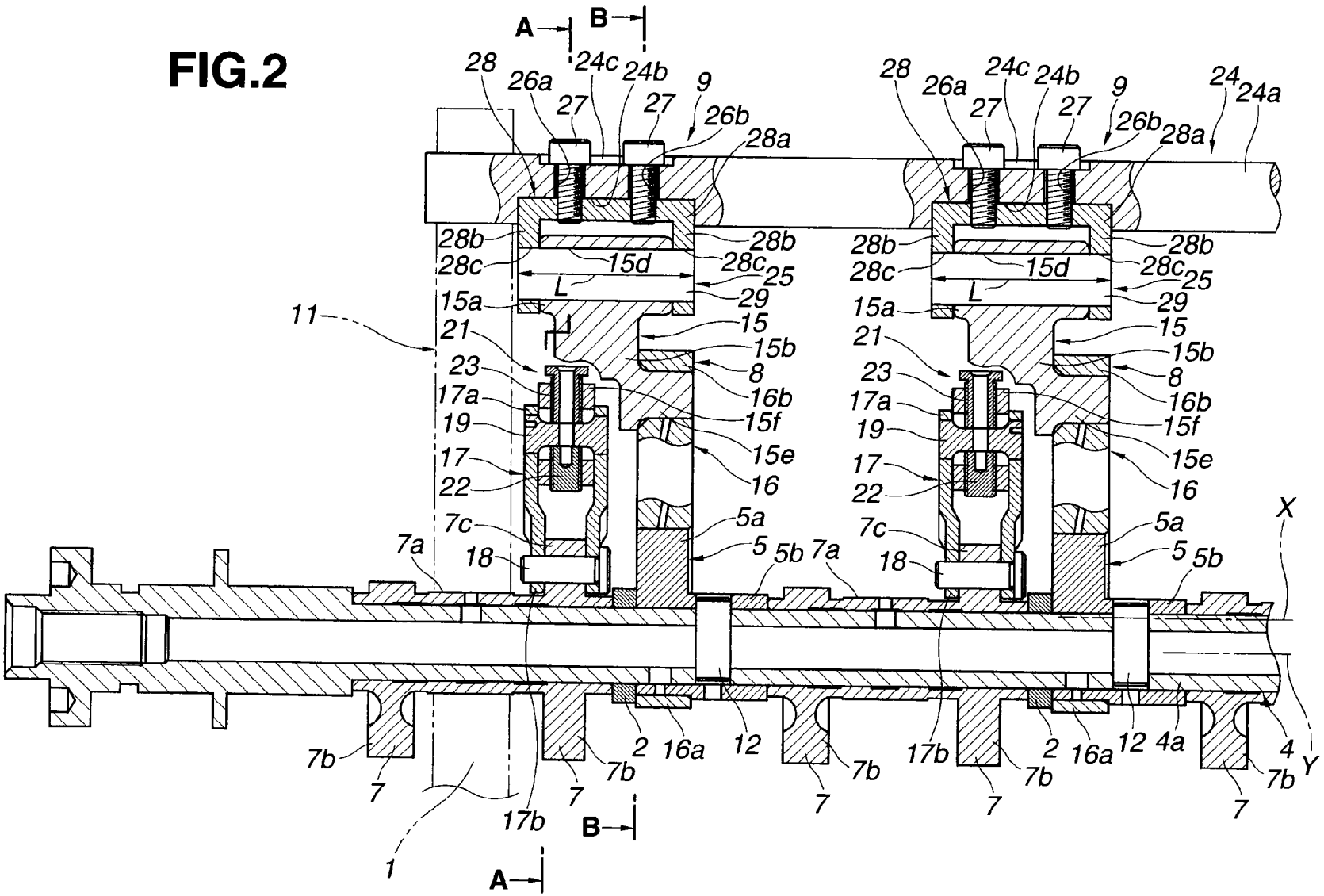
FIG. 2 is an elevation view in cross-section, illustrating the essential part of the variable valve actuation apparatus of the first embodiment.

Referring now to the drawings, particularly to FIGS. 1-2, the variable valve actuation apparatus of the first embodiment is exemplified in an internal combustion engine having four valves for each cylinder, namely, two intake valves and two exhaust valves per one cylinder. In the first embodiment shown in FIGS. 1-2, the variable valve actuation apparatus of the first embodiment is applied to only the intake-valve side.

As shown in FIGS. 1-2, the variable valve actuation apparatus of the first embodiment is comprised of a cylindrical-hollow drive shaft 4 arranged to extend in a longitudinal direction of the engine, a pair of rockable cams 7, 7 provided for actuating respective intake valves 3, 3 via a pair of swing arms 6, 6, each of which serves as a roller follower resting on the tip of the valve stem of the associated intake valve 3, a motion transmission mechanism 8 (simply, a motion converter), which mechanically links a drive eccentric cam 5, fixedly connected to drive shaft 4, to the rockable-cam pair 7, 7 for converting a torque (rotary motion) of drive eccentric cam 5 into oscillating motion to cause an oscillating force for the rockable-cam pair 7, 7, and a control mechanism 9 provided for variably controlling both a valve lift amount and a working angle of each of intake valves 3, 3 by varying the attitude of motion transmission mechanism 8 depending on an engine operating condition, such as engine load and speed.

The previously-discussed "working angle" means a valve open period during which intake valve 3 is open. In more detail, the "working angle" corresponds to an effective lift section, ranging from the point immediately after the leading edge of the positive valve opening acceleration (except a moderate valve-opening ramp section, which permits moderate valve movement in the first stage (the initial stage) of opening motion of intake valve 3) to the point immediately before the trailing edge of the positive valve closing acceleration (except a moderate valve-closing ramp section, which permits moderate valve movement in the last stage of closing motion of intake valve 3). Additionally, in the shown embodiment, the angle of drive shaft 4, ranging from the leading edge (the starting point) of the positive valve opening acceleration to a peak lift PL, is called "valve-opening working angle", whereas the angle of drive shaft 4, ranging from the peak lift PL to the trailing edge (the end point) of the positive valve closing acceleration is called "valve-closing working angle". That is, the working angle is equal to the summed value of the valve-opening working angle and the valve-closing working angle (see the characteristic diagram of FIG. 10).

Intake valve 3 is installed to be permanently forced in a direction for closing of the intake-valve port by a valve spring (not shown), which is disposed between a substantially cylindrical recessed spring seat section formed in a cylinder head 1 and a spring retainer (not shown) attached to the tip of the valve stem of intake valve 3, under preload.

Drive shaft 4 is basically constructed by a hollow drive support shaft 4*a*. Drive eccentric cam 5 is fixedly connected to and installed on the outer periphery of drive support shaft 4*a*. Both axial ends of drive shaft 4 are rotatably supported by bearings 11 installed on the upper portion of cylinder head 1. Although it is not clearly shown in the drawing, in the shown embodiment, a variable valve timing control (VTC) system, often abbreviated to "cam phaser", which variably controls a phase of an engine valve, is further installed on one axial end of drive shaft 4, in addition to the previously-discussed multinodular-link variable valve actuation apparatus. That is, the variable valve actuation apparatus (i.e., the continuous variable valve event and lift control (VEL) system) of the first embodiment is combined with the "cam phaser" (the VTC system). For instance, such a "cam phaser" has been disclosed in Japanese Patent Provisional Publication No. 2006-307658 (hereinafter is referred to as "JP2006-307658"). A torque (rotary motion) is transmitted from an engine crankshaft (not shown) through the cam phaser (the VTC system) to drive shaft 4, such that drive shaft 4 rotates clockwise (viewing FIG. 1) during operation of the engine.

Drive eccentric cam 5 is comprised of a substantially disc-shaped cam body 5*a* and an axially-extending cylindrical boss 5*b* formed integral with cam body 5*a*. Drive eccentric cam 5 is fixedly connected to drive support shaft 4*a* by a mounting pin 12, which is press-fitted into a radial location-fit bore formed in the boss 5*b*. Drive eccentric cam 5 is arranged near one axial end (near the right-hand axial end in FIG. 2) of the associated rockable-cam pair 7, 7 such that boss 5*b* and rockable-cam pair 7, 7 are located on the opposite sides of cam body 5*a*. Therefore, cam body 5*a* is located on the side of rockable-cam pair 7, 7 through a spacer 2. Cam body 5*a* of drive eccentric cam 5 has a cylindrical cam profile whose geometric center "X" is displaced from the shaft axis (the shaft center) "Y" of drive support shaft 4*a* by a given radial offset. In other words, the shaft axis "Y" of drive support shaft 4*a* serves as a rotation center of drive eccentric cam 5. The geometric center "X" of cam body 5*a* is configured as a first fulcrum "X" of drive eccentric cam 5 included in the multinodular-link variable valve actuation apparatus.

As seen in FIG. 1, the underside of one end 6*a* of swing arm 6 is kept in abutted-engagement with the stem end of intake valve 3. The substantially semi-spherically recessed underside of the other end 6*b* of swing arm 6 is attached to the semi-spherically convex head of a small piston of a hydraulically-operated valve-lash adjuster 13, which piston fits in a hollow cylinder of the lash adjuster installed on cylinder head 1. Swing arm 6 oscillates about the semi-spherical convex head of the valve-lash-adjuster piston. That is, the head serves as a pivot about which swing arm 6 pivots. Swing arm 6 has a substantially C-shaped lateral cross-section. A roller 14 is rotatably supported substantially at a midpoint of swing arm 6. Rockable cam 7 is in kept in rolling-contact with roller 14 of swing arm 6.

Figure 4A:
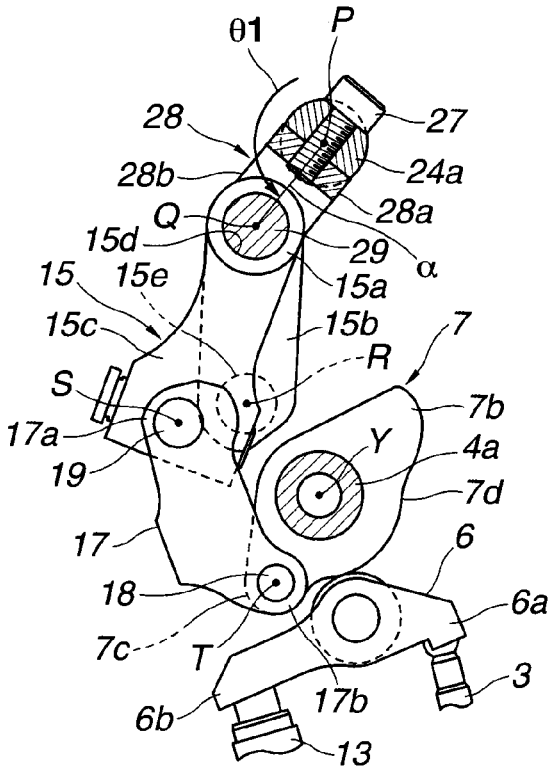

As best seen in FIGS. 1 and 4A, rockable cam 7 has a substantially raindrop shape. The basal ends (base-circle portions) of rockable-cam pair 7, 7 are formed integral with each other via a cylindrical-hollow camshaft 7*a*. That is, the rockable-cam pair 7, 7 and cylindrical-hollow camshaft 7*a* are integrally formed with each other. Cylindrical-hollow camshaft 7*a* is rotatably fitted onto the outer peripheral surface of drive support shaft 4*a* of drive shaft 4, in such a manner as to permit oscillating motion of rockable-cam pair 7, 7 about the shaft axis "Y" of drive support shaft 4*a*. That is, the shaft axis "Y" also serves as a pivot of oscillating motion of rockable-cam pair 7, 7. Rockable cam 7 has a cam contour surface portion 7*d* formed on the underside of rockable cam 7 between the basal end (the base-circle portion) and a cam nose portion 7*b*. Cam contour surface portion 7*d* has a base-circle surface on the basal-end side, a circular-arc shaped ramp surface extending from the base-circle surface toward cam nose portion 7*b*, and a lift surface being continuous with the ramp surface and extending toward a top surface (a maximum lift surface of cam nose portion 7*b*). During operation of the engine, the base-circle surface, the ramp surface, the lift surface, and the top surface, all constructing the cam contour surface, are brought into abutted-engagement with the rolling surface of the associated swing-arm roller 14 displacing upward and downward, in turn, depending on the position of oscillating motion of rockable cam 7.

Regarding the rockable cam pair 7, 7, during an intake-valve opening period that the rolling-contact position (the abutment position) of cam contour surface portion 7*d* in rolling-contact with roller 14 is shifting toward the lift surface, the direction of oscillating motion of each rockable cam 7 is set to be identical to the direction of rotation of drive shaft 4 (see the clockwise direction indicated by the arrow in FIG. 1). That is, pulling up the basal-end side of rockable cam 7 by a link rod (described later) causes intake valve 3 to be lifted off the seat in a direction for opening of the intake-valve port. Due to a friction between the outer periphery of drive shaft 4 and the inner periphery of the base-circle portion of rockable cam 7 rotatably supported by drive shaft 4, a dragging torque is produced in the direction that intake valve 3 lifts during the intake-valve opening period, such that oscillating motion (i.e., clockwise rotation) of rockable cam 7 is efficiently assisted by rotation of drive shaft 4. Therefore, the driving efficiency of rockable cam 7 can be enhanced.

Of these rockable cams 7, 7, the first rockable cam 7 arranged closer to drive eccentric cam 5 than the second rockable cam 7, has a radially-protruded connecting portion 7*c* integrally formed with the base-circle portion, such that cam nose portion 7*b* and connecting portion 7*c* are arranged on the opposite sides of cylindrical-hollow camshaft 7*a*. Connecting portion 7*c* has a through hole, into which a connecting pin 20 fits, for mechanically linking the rockable-cam pair 7, 7 to the lower end 17*b* of link rod 17 (described later).

Roller 14 is installed on swing arm 6, such that the rolling-contact surface of roller 14 is arranged at a higher level than the two uppermost edged portions of swing arm 6, so as to define a proper clearance space between swing arm 6 and rockable cam 7 and a proper clearance space between swing arm 6 and link-rod lower end 17*b*. By the provision of such proper clearance spaces, it is possible to prevent undesirable interference between swing arm 6 and connecting portion 7*c* of the first rockable cam and undesirable interference between swing arm 6 and the lower end 17*b* of link rod 17, during operation of the engine. Therefore, as can be appreciated from the side view of FIG. 4A, even when cam nose portion 7*b* of rockable cam 7 reaches the highest level, by virtue of the previously-noted proper clearances, it is possible to prevent the undesirable interference between the moving parts, concretely, the undesirable interference between roller 14 and connecting portion 7*c* of the first rockable cam 7. The previously-described roller-type swing arm 6 (serving as a roller cam follower in rolling-contact with rockable cam 7) is superior to a typical bucket-type valve lifter (serving as a flat-face follower in sliding-contact with a cam) with respect to a less interference between moving parts and a reduced friction loss.

As clearly seen in FIGS. 1-4B, in the shown embodiment, motion transmission mechanism 8 (the motion converter) is constructed by a multinodular-link mechanism (a multinodular-link motion converter). Multinodular-link motion transmission mechanism 8 is comprised of a rocker arm 15 located above drive shaft 4 and arranged in the lateral direction of the engine, a link arm 16 linking rocker arm 15 to drive eccentric cam 5, and link rod 17 linking rocker arm 15 to connecting portion 7*c* of the first rockable cam 7.

Figure 3A:
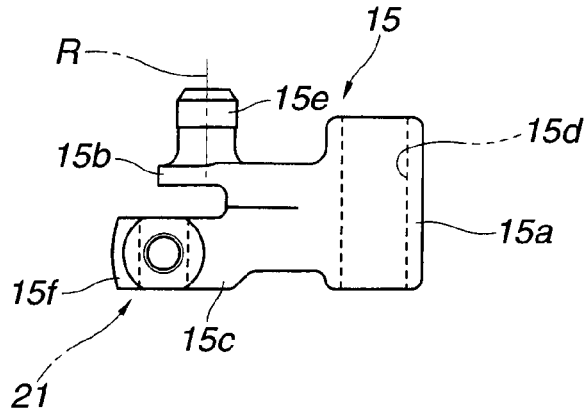
Figure 3B:
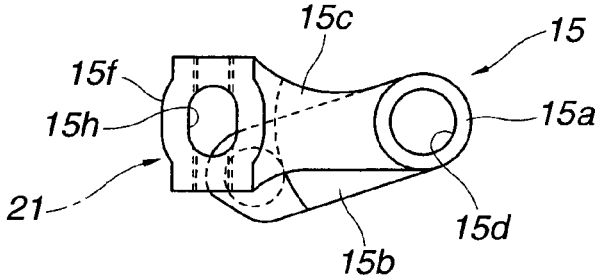
FIG. 3B is a side view of the same rocker arm.

As shown in FIGS. 3A-3B, rocker arm 15 is comprised of a cylindrical-hollow basal portion 15*a* pivotably supported by a control eccentric shaft 29 (described later), and a pair of forked arm portions 15*b* and 15*c* both formed integral with each other and arranged substantially in parallel with each other.

Basal portion 15*a* has a shaft-support bearing bore 15*d*, which is loosely fit onto the outer periphery of control eccentric shaft 29 (described later) with a slight clearance.

First arm portion 15*b* is formed integral with a small shaft portion 15*e*, protruded from the outside wall surface of the tip of first arm portion 15*b*. A lobed end portion 16*b* of link arm 16 is rotatably linked to the protruded shaft portion 15*e* of first arm portion 15*b*. The geometric center "R" of the protruded shaft portion 15*e* of first arm portion 15*b* of rocker arm 15 is configured as a second fulcrum "R" (of link arm 16). On the other hand, the tip of second arm portion 15*c* is shaped into a block portion 15*f*. Block portion 15*f* of second arm portion 15*c* is provided with a valve lift adjustment mechanism 21. The upper end 17*a* of link rod 17 is rotatably linked to a pivot pin 19 (described later) of lift adjustment mechanism 21. The geometric center "S" of pivot pin 19 is configured as a third fulcrum "S". Block portion 15*f* is formed with a pin slot 15*h* bored as an elliptic through hole extending in the axial direction of cylindrical-hollow basal portion 15*a*, in such a manner as to penetrate both side walls of block portion 15*f*.

As appreciated from the side view of FIG. 3B, the previously-discussed first and second arm portions 15*b* and 15*c* are configured to be offset from each other by a predetermined angle in the direction of oscillating motion of rocker arm 15. In other words, as viewed from the sidewall side of first and second arm portions 15*b* and 15*c*, there is an offset angle between the longitudinal directions of these arm portions 15*b*-15*c*. More concretely, the tip of first arm portion 15*b* is slightly inclined downward from the tip of second arm portion 15*c* by a slight inclination angle.

Figure 4B:
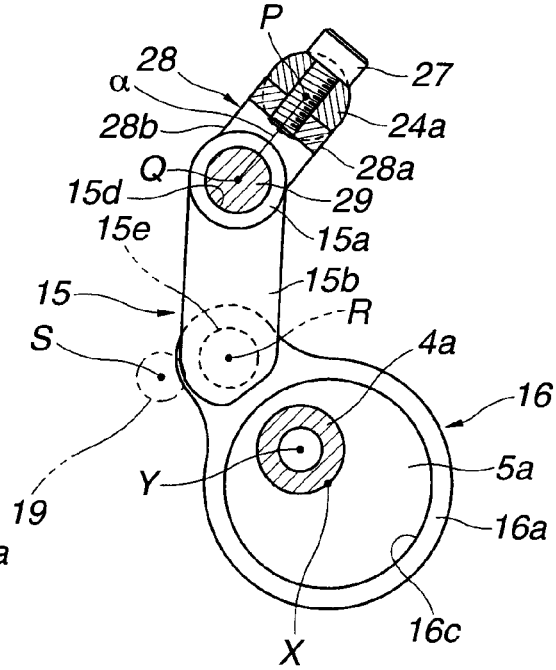
FIG. 4B is a side view of the multinodular-link motion transmission mechanism in partial cross-section taken along the line B-B of FIG. 2 during the valve closing period at the minimum working-angle control mode.

As best seen from the side view of FIG. 4B, link arm 16 is comprised of a comparatively large-diameter annular portion 16*a* and lobed end portion 16*b* protruded from a predetermined angular position of the outer peripheral surface of annular portion 16*a*. Annular portion 16*a* is formed with a central bore 16*c*, into which drive eccentric cam 5 is rotatably fitted.

As seen from the perspective view of FIG. 1, link rod 17 is formed into a substantially C-shape or a substantially circular-arc shape in lateral cross-section by pressing, from the viewpoint of high rigidity, lightweight, and compactification. As best shown in FIG. 4A, two parallel pronged portions of the upper end 17*a* of link rod 17 are linked to second arm portion 15*c* by means of pivot pin 19, whereas two parallel pronged portions of the lower end 17*b* of link rod 17 are rotatably linked to connecting portion 7*c* of the first rockable cam 7 by means of a connecting pin 18. The geometric center "T" of connecting pin 18 is configured as a fourth fulcrum "T". As seen in FIG. 1, multinodular-link motion transmission mechanism 8 has only one link rod 17 per cylinder. This contributes to the more simplified linkage structure, thus ensuring lightweight.

Intake valve 3 is actuated by pulling up connecting portion 7*c* of the first rockable cam 7 via link rod 17, but cam nose portion 7*b*, which receives an input motion from roller 14 of swing arm 6, is located on the opposite side of connecting portion 7*c* of the first rockable cam 7 with respect to the center of oscillating motion of rockable-cam pair 7, 7, that is, the shaft axis "Y" of drive support shaft 4*a*. By virtue of such a linkage layout of link rod 17, the first rockable cam 7 having both the connecting portion 7*c* and the cam nose portion 7*b*, and roller 14 of swing arm 6, it is possible to suppress the rockable-cam pair 7, 7 from unintentionally falling or rotating about the center of oscillating motion, i.e., the shaft axis "Y".

As shown in FIGS. 1-2, in particular, as best seen in FIG. 2, lift adjustment mechanism 21 is comprised of pivot pin 19, an adjusting bolt (an adjusting screw) 22, and a lock bolt (or a lock screw) 23. Pivot pin 19 is installed in pin slot 15*h* of block portion 15*f* of second arm portion 15*c* of rocker arm 15. Adjusting bolt 22 is threadably engaged with the adjusting female-screw tapped hole formed in block portion 15*f* and ranging from the bottom face of block portion 15*f* to pin slot 15*h*. Lock bolt 23 is threadably engaged with the lock female-screw tapped hole formed in block portion 15*f* and ranging from the upper face of block portion 15*f* to pin slot 15*h*. After assembling of the component parts, extremely small adjustments of the lift amount of each of intake valves 3, 3 are made by adjusting the installation position (the pivot point or the third fulcrum "S") of pivot pin 19 in pin slot 15*h* by means of adjusting bolt 22. At the point of time when such extremely small adjustments of the lift amount of each intake valve 3 have been made, tightening lock bolt 23 allows the installation position of pivot pin 19 to be fixed and thus allows the extremely small adjustments of the lift amount to be completed.

Control mechanism 9 is comprised of a control shaft 24 located above drive shaft 4 and arranged in parallel with the shaft axis (the shaft center) "Y" of drive support shaft 4*a*, and an actuator (not shown), such as an electric actuator that drives control shaft 24.

As shown in FIGS. 1-2, and 4A-4B, control shaft 24 is comprised of a control support shaft 24*a*, and a plurality of control eccentric cams 25, 25, . . . , attached to the outer periphery of control support shaft 24*a* and provided for each engine cylinder. Control eccentric cam 25 (exactly, a control eccentric shaft 29 (described later) constructing part of control eccentric cam 25) serves as a fulcrum of oscillating motion of the associated rocker arm 15.

As best seen in FIGS. 1-2, control support shaft 24*a* is formed with width-across-flat recessed portions 24*b*-24*c*, 24*b*-24*c*, . . . , at its axial positions corresponding to respective rocker arms 15, 15, . . . . Additionally, two radial bolt insertion holes 26*a*-26*b* are bored in each width-across-flat recessed portions 24*b*-24*c* of control support shaft 24*a* and axially spaced apart from each other by a predetermined axial distance, such that radial bolt insertion holes 26*a*-26*b* penetrate the bottom flat face of one-side recessed portion 24*b* and the bottom flat face of the opposite-side recessed portion 24*c*.

Control eccentric cam 25 is comprised of a substantially U-shaped bracket 28 and control eccentric shaft 29. Bracket 28 is secured and fixedly connected onto the bottom flat face of one-side recessed portion 24*b* by screwing two bolts 27, 27 from the opposite-side recessed portion 24*c* through bolt insertion holes 26*a*-26*b* into respective female-screw tapped holes formed in a rectangular basal portion 28*a* of bracket 28. Both ends of control eccentric shaft 29 are fixedly connected to respective tab-like support portions 28*b*, 28*b* in a manner so as to interconnect these tab-like support portions via control eccentric shaft 29. The axis of control eccentric shaft 29 is arranged parallel to the axis of control support shaft 24*a*.

Rectangular basal portion 28*a* of bracket 28 is configured to be substantially conformable to the shape of the bottom flat face of one-side recessed portion 24*b*, such that the rectangular outside surface of basal portion 28*a* just abuts and fits with the bottom flat face of one-side recessed portion 24*b* and that two parallel tab-like support portions 28*b*, 28*b* just abut and fit with the two opposing inside walls of one-side recessed portion 24*b*. This contributes to the enhanced positioning accuracy of each of brackets 28, 28, . . . of control eccentric cams 25, 25, . . . , with respect to control shaft 24 in the longitudinal direction. Two parallel tab-like support portions 28*b*, 28*b* are configured to be bent at both ends of rectangular basal portion 28*a* at a right angle. The tips of tab-like support portions 28*b*, 28*b* have respective bores 28*c*, 28*c* into which both ends of control eccentric shaft 29 are fixedly connected, for example, by press-fitting.

Control eccentric shaft 29 is provided to pivotably support rocker arm 15 such that shaft-support bearing bore 15*d* of cylindrical-hollow basal portion 15*a* of rocker arm 15 is loosely fitted onto the outer peripheral surface of control eccentric shaft 29. The axial length L of control eccentric shaft 29 is dimensioned to be identical to the distance between the outside wall surfaces of two parallel tab-like support portions 28*b*, 28*b*, such that both end faces of control eccentric shaft 29 are flush with respective outside wall surfaces of two parallel tab-like support portions 28*b*, 28*b*. As previously-discussed, both ends of control eccentric shaft 29 are press-fitted into respective bores 28*c*, 28*c* of tab-like support portions 28*b*, 28*b*. The geometric center "Q" of control eccentric shaft 29 serves as a fulcrum of oscillating motion of the associated rocker arm 15. The geometric center "Q" of control eccentric shaft 29 is configured as a fifth fulcrum "Q".

The structural component parts, constructing the multinodular-link motion transmission mechanism 8, (that is, rocker arm 15, link arm 16, and link rod 17) ranging from the outside wall surface (the right-hand sidewall surface, viewing in FIG. 2) of disc-shaped cam body 5*a* of drive eccentric cam 5 to the outside wall surface (the left-hand sidewall surface, viewing FIG. 2) of link rod 17 linked to the first rockable cam 7, are all arranged compactly within a range of the axial length L of control eccentric shaft 29.

As shown in FIGS. 4A-4B, the fifth fulcrum "Q" of control eccentric shaft 29 is eccentric to the shaft axis (the shaft center) "P" of control support shaft 24*a* by a comparatively large eccentricity "α" owing to the arm length of each of tab-like support portions 28*b*, 28*b* of bracket 28. In other words, control eccentric shaft 29 is cranked with respect to the shaft axis "P" of control support shaft 24*a* via bracket 28, thus ensuring an adequately large eccentricity "α" of the geometric center "Q" (the fifth fulcrum "Q") of control eccentric shaft 29 (i.e., a revolving body) from the shaft axis "P" of control support shaft 24*a*.

In the shown embodiment, control eccentric cam 25 is constructed by the U-shaped bracket 28 and control eccentric shaft 29, both integrally installed on control support shaft 24*a*. In lieu thereof, in order to enhance the rigidity of control eccentric cam 25, each of two parallel tab-like support portions 28*b*, 28*b* of bracket 28 may be replaced with a cylindrical eccentric cam integrally connected to the outer periphery of control support shaft 24*a*.

The previously-discussed electric actuator that drives control shaft 24, is constructed by an electric motor, installed on the rear end of cylinder head 1, and a speed reduction mechanism, such as a ball screw mechanism, which transmits a driving torque of the electric motor to control support shaft 24*a*, with a speed reduction and a torque increase.

In the shown embodiment, the electric motor is comprised of a proportional-control direct-current (DC) motor. The operation of the proportional-control DC motor is controlled responsively to a control signal from an electronic control unit, simply a controller (not shown), depending on an engine operating condition. The controller generally comprises a microcomputer. The controller includes an input/output interface (I/O), memories (RAM, ROM), and a microprocessor or a central processing unit (CPU). The input/output interface (I/O) of the controller receives input information from various engine/vehicle sensors, namely a crank angle sensor (or a crankshaft position sensor), an airflow meter, an engine temperature sensor, a potentiometer, and the like. The crank angle sensor is provided for detecting revolutions of the engine crankshaft. The airflow meter is provided in an intake-air passage for detecting an actual intake-air flow rate. The engine temperature sensor, such as an engine coolant temperature sensor, is provided for sensing the actual operating temperature of the engine. The potentiometer is provided for detecting an angular position of control shaft 24. Within the controller, the central processing unit (CPU) allows the access by the I/O interface of input informational data signals from the previously-discussed engine/vehicle sensors. The CPU of the controller is configured to compute the current engine operating condition based on the input information, and is responsible for carrying the engine control program stored in memories and also capable of performing necessary arithmetic and logic operations containing an actuator control management processing. Computational results (arithmetic calculation results), that is, calculated output signals are relayed through the output interface circuitry of the controller to output stages, namely, the electric motor of the actuator. The angular position of control shaft 24 can be quickly changed by electric motor control, regardless of the engine oil temperature. That is, the proportional-control DC motor equipped actuator contributes to the enhanced working-angle-control responsiveness.

As previously described, although it is not clearly shown in the drawing, in the shown embodiment, the VTC system (i.e., the "cam phaser"), which variably controls a phase of an engine valve (intake valves 3, 3) depending on the engine operating condition, is further installed on the front axial end of drive support shaft 4*a*, in addition to the previously-discussed multinodular-link variable valve actuation apparatus. For instance, the VTC system (the "cam phaser") may be constructed by a hydraulically-operated vane-type timing variator. As is generally known, the hydraulically-operated vane-type timing variator includes a timing sprocket rotatably installed on the front end of drive support shaft 5*a* and having a driven connection with the engine crankshaft, a vane member fixedly connected to the front end of drive support shaft 4*a* and rotatably disposed in a cylindrical housing, with which the timing sprocket is integrally formed, and a hydraulic circuit, which is provided for supplying hydraulic pressure selectively to either one of each of phase-retard chambers and each of phase-advance chambers to change an angular phase of the vane member relative to the housing. The phase-retard chambers and phase-advance chambers are defined between the vane member and the housing. Also provided is an electromagnetic directional control valve, which is disposed in the hydraulic circuit, for switching supply and exhaust of hydraulic pressure, produced by an oil pump, to and from either one of each of the phase-retard chambers and each of the phase-advance chambers. The operation of the electromagnetic directional control valve is also controlled responsively to a control signal from the controller. This type of VTC system is hydraulically- rather than electrically-operated. Thus, generally, the hydraulically-operated VTC system is inferior in control responsiveness. The operation of the hydraulically-operated VTC system tends to be remarkably affected by the engine oil temperature.

The variable valve actuation apparatus of the first embodiment is configured to variably continuously control a valve lift characteristic (including both a valve lift amount and a working angle of each of intake valves 3, 3) from a minimum working angle (exactly, a minimum working-angle and valve-lift characteristic) to a maximum working angle (exactly, a maximum working-angle and valve-lift characteristic) by controlling the angular position of control support shaft 24*a* by the electric actuator depending on the engine operating condition. As hereunder described, the apparatus of the first embodiment is further configured to phase-change intake-valve open timing IVO in the phase-advance direction during a middle working-angle control mode, by specifying the mutual positional relationship among the first fulcrum "X" (i.e., the geometric center "X" of cam body 5*a*), the second fulcrum "R" (i.e., the geometric center "R" of shaft portion 15*e* of first arm portion 15*b* of rocker arm 15), and the third fulcrum "S" of link rod 17 (i.e., the geometric center "S" of pivot pin 19) depending on the position of rotation of control support shaft 24*a*.

The positive acceleration characteristic of the intake-valve lift increasing side and the positive acceleration characteristic of the intake-valve lift decreasing side, obtained during a working angle control execution time period extending from the minimum working-angle control mode to the maximum working-angle control mode, are peculiar to the apparatus of the first embodiment. The operating characteristic (the specific valve lift characteristic and the specific valve acceleration characteristic) of the variable valve actuation apparatus of the first embodiment is hereinbelow described in detail by reference to the drawings.

[During Minimum Working Angle Control Mode]

First, when drive support shaft 4*a* rotates in the clockwise direction indicated by the arrow in FIG. 1 by a driving torque from the engine crankshaft, drive eccentric cam 5 rotates in the same direction as the direction of rotation of drive support shaft 4*a*, and then the rotary motion is transmitted via link arm 16 to rocker arm 15. Thus, rocker arm 15 oscillates or pivots about the fifth fulcrum "Q" of control eccentric shaft 29 to move link rod 17 up and down to cause oscillating motion of the rockable-cam pair 7, 7. Oscillating motions of rockable-cam pair 7, 7 are transmitted through the cam contour surface portions 7*d*, 7*d* via rollers 14, 14 of swing arms 6, 6 to the valve-stem ends of intake valves 7, 7, to actuate intake valves 3, 3.

For instance, during idling of the engine at low speeds, control support shaft 24*a* is rotated to the angular position, corresponding to a rotation angle "θ1" (see FIG. 4A), in the anticlockwise direction by the electric actuator responsively to a control signal from the controller. Therefore, as shown in FIGS. 4A-4B and 5A-5B, control eccentric shaft 29 is displaced to a revolution position, corresponding to rotation angle "θ1", such that the fifth fulcrum "Q" (the shaft center of control eccentric shaft 29) is displaced to the upper and left position with respect to drive support shaft 4*a*. As a whole, the attitude of multinodular-link motion transmission mechanism 8 is displaced in such a manner as to be somewhat inclined anticlockwise with respect to drive support shaft 4*a*, thereby simultaneously causing a change in the attitude of rockable-cam pair 7, 7 to the anticlockwise direction. As a result, the rolling-contact position (the abutment position) of roller 14 of swing arm 6 is displaced toward the base-circle portion of cam contour surface portion 7*d*.

Figure 5A:
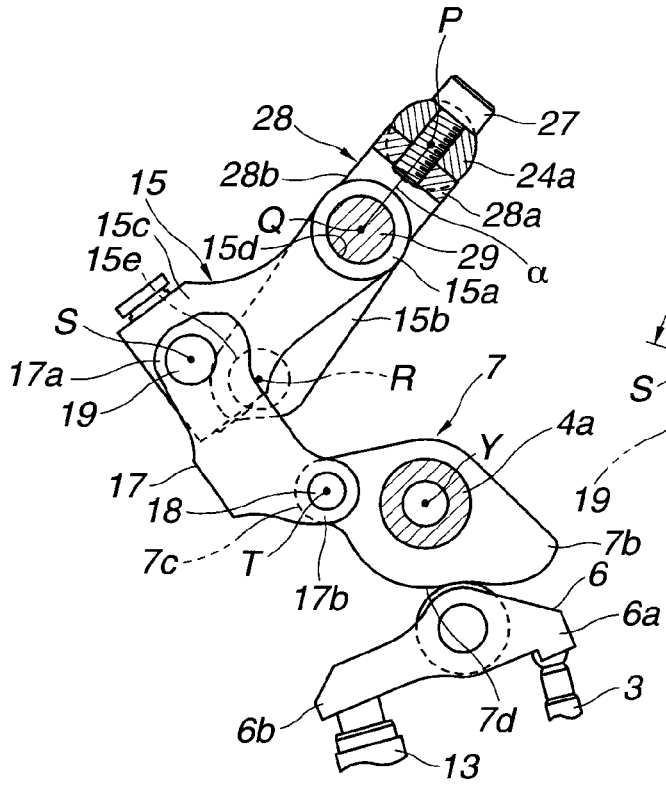

Therefore, as shown in FIG. 5A, when rocker arm 15 is pushed up via link arm 16 by rotary motion of drive eccentric cam 5, connecting portion 7*c* of the first rockable cam 7 is lifted or pulled up via link rod 17, to rotate the rockable-cam pair 7, 7 clockwise. The clockwise rotation of rockable cam 7 (i.e., the valve-lifting motion of rockable cam 7, caused by the displacement of the rolling-contact position of cam contour surface portion 7*d* of rockable cam 7 toward the lift surface) is transmitted via roller 14 of swing arm 6 to the associated intake valve 3 to lift the intake valve. During idling at low speeds, due to the attitude of multinodular-link motion transmission mechanism 8 determined based on rotation angle "θ1", a lift amount and a working angle of intake valve 3 become adequately small.

Figure 10:
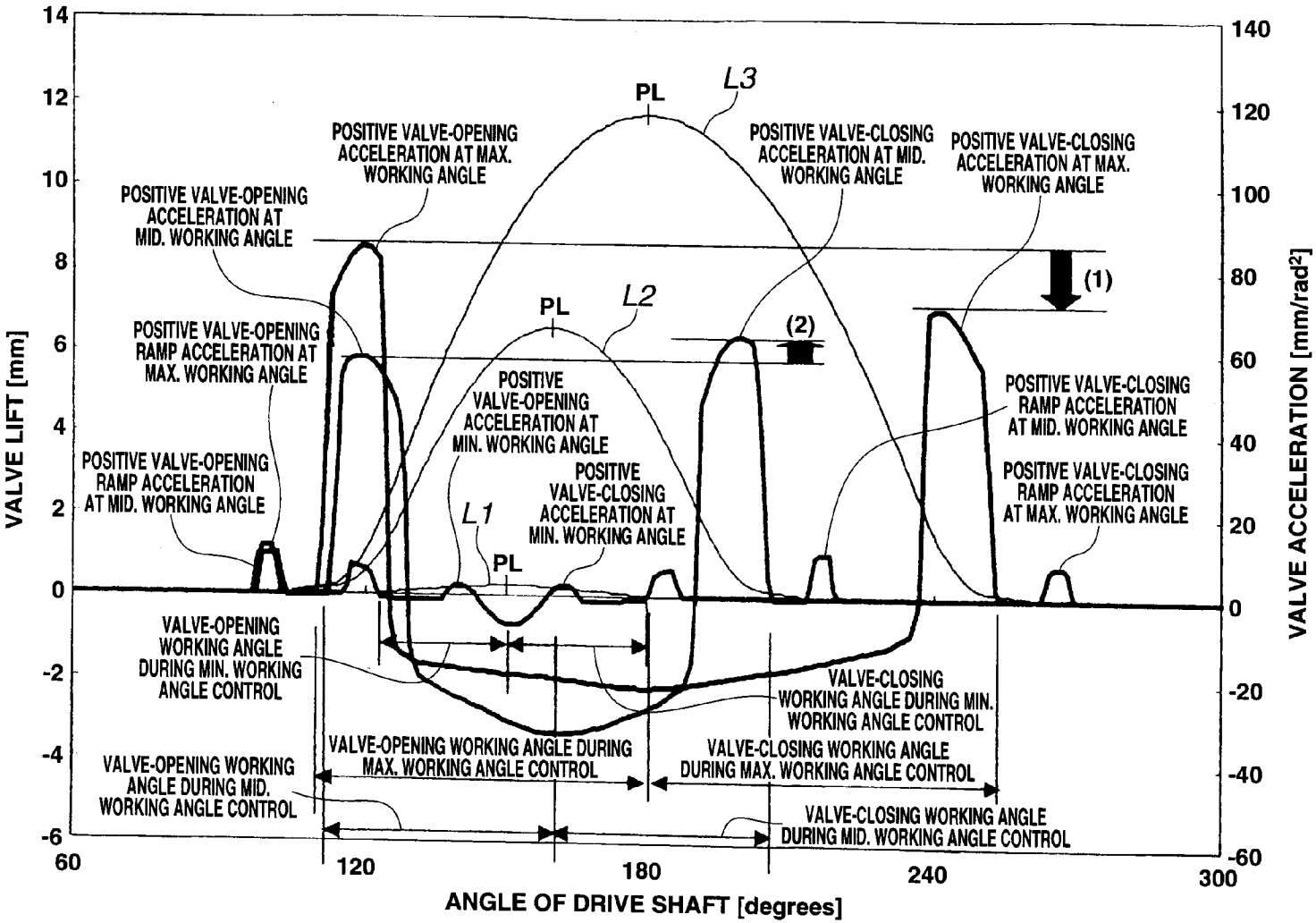
FIG. 10 is a characteristic diagram illustrating the relationship between a valve lift and a valve acceleration in the apparatus of the first embodiment.

Therefore, as clearly shown in FIG. 10, in a low-speed and light-load range of the engine, a valve lift amount of each of intake valves 3, 3 becomes an adequately small lift amount L1. Hence, the intake-valve open timing IVO of each of intake valves 3, 3 phase-retards, thus realizing no valve overlap of open periods of intake and exhaust valves. This contributes to the improved combustion and reduced fuel consumption rate and stable engine speeds (enhanced idling stability).

The valve acceleration characteristic, obtained at the minimum working-angle control mode, is hereunder described or studied in detail by reference to FIGS. 4A-4B, 5A-5B, 10, and 11. FIG. 10 shows the intake-valve lift and valve acceleration characteristics, obtained at respective working angle control modes, namely, during a valve closing period at the minimum working-angle control mode shown in FIGS. 4A-4B, during a valve opening period at the minimum working-angle control mode shown in FIGS. 5A-5B, during a valve closing period at the middle working-angle control mode shown in FIGS. 6A-6B, during a valve opening period at the middle working-angle control mode shown in FIGS. 7A-7B, during a valve closing period at the maximum working-angle control mode shown in FIGS. 8A-8B, and during a valve opening period at the maximum working-angle control mode shown in 9A-9B. In FIG. 10, the axis of abscissa indicates an angle (unit: rad) of drive shaft 4. The valve acceleration of intake valve 3 is represented as the second-order derivative (unit: mm/rad$^2$) of a valve lift (unit: mm) with respect to angle of drive shaft 4.

Figure 11:
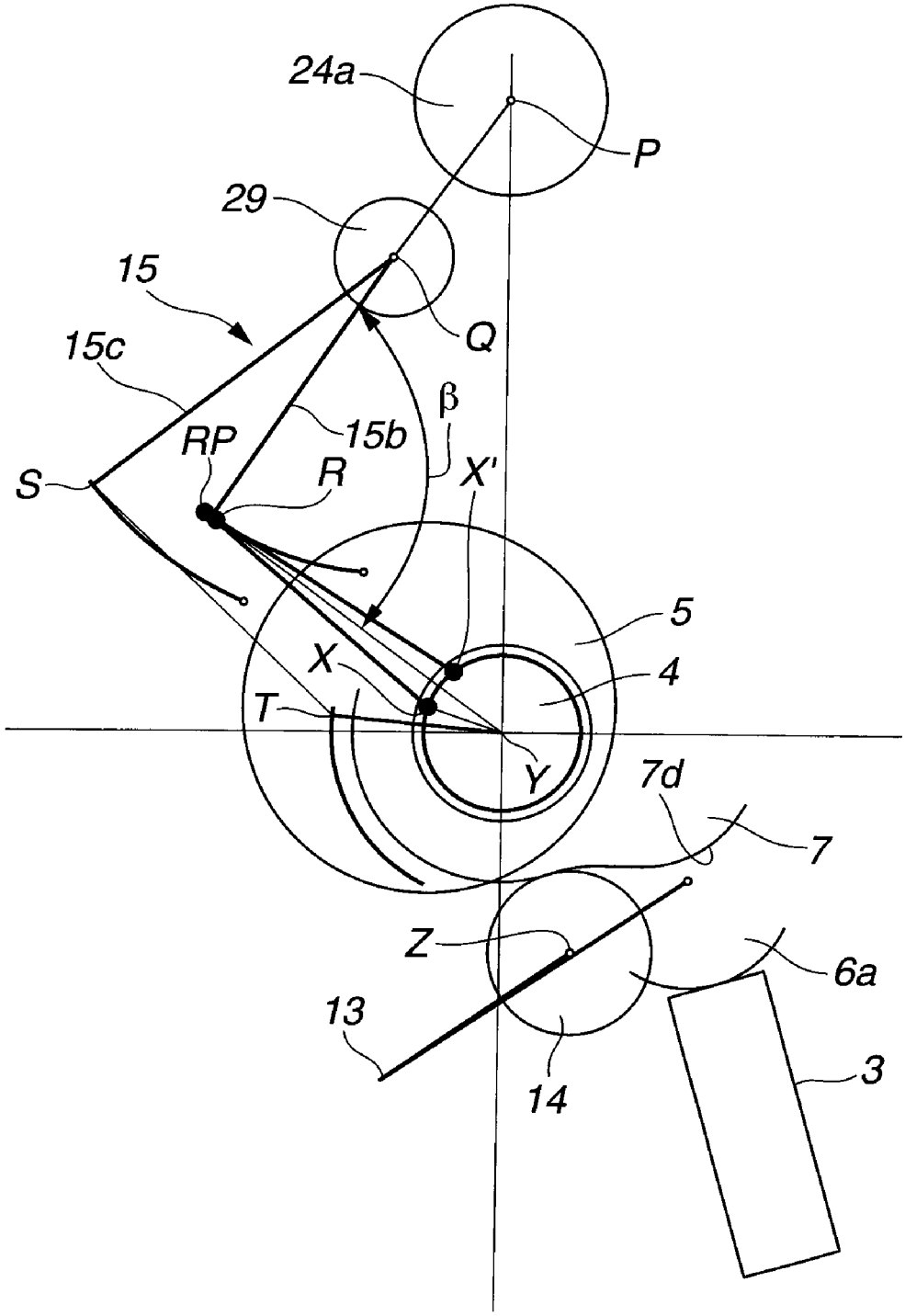
FIG. 11 is a linkage diagram illustrating the operating attitudes of respective moving parts of the multinodular-link motion transmission mechanism of the apparatus of the first embodiment at the minimum working-angle control mode.

The positions of the shaft axis (the shaft center) "P" of control support shaft 24*a*, the geometric center "Q" (the fifth fulcrum "Q") of control eccentric shaft 29, the shaft axis (the shaft center) "Y" of drive support shaft 4*a*, and the positions of the pivots, shown in FIG. 11, conform to those shown in FIGS. 4A-4B and 5A-5B. Additionally, the moving points of FIG. 11, namely, the geometric center "R" of the protruded shaft portion 15*e* of first arm portion 15*b* of rocker arm 15, the geometric center "S" of pivot pin 19, the geometric center "T" of connecting pin 18, and the first fulcrum "X" (i.e., the geometric center "X" of cam body 5*a*), and the geometric center "Z" of roller 14 show their instantaneous positions at the valve-opening working angle starting point, that is, at the starting point of the positive valve opening acceleration, in other words, at a point of the valve-opening ramp lift.

The point "X" shown in FIG. 11 indicates the position of the geometric center of drive eccentric cam 5 at the valve-opening working angle starting point, whereas the connecting point of link arm 16 and rocker arm 15 is the position of the second fulcrum "R" at the valve-opening working angle starting point.

Next, regarding the positions of the geometric center "X" of drive eccentric cam 5 and the second fulcrum "R" at the valve-closing working angle end point, the intake-valve lift (the valve-closing ramp lift) at the working angle end point is set to be identical to the intake-valve lift (the valve-opening ramp lift) at the working angle starting point. Hence, the position of the second fulcrum "R" at the valve-opening working angle starting point becomes substantially identical to the position of the second fulcrum "R" at the valve-closing working angle end point. Assuming that the position of the geometric center of drive eccentric cam 5 at the valve-closing working angle end point is indicated as a point "X'", then the line segment "X'-Y" becomes equal to the line segment "X-Y" (i.e., the eccentricity of drive eccentric cam 5) and the line segment "X'-R" becomes equal to the line segment "X-R" (i.e., the center distance of link arm 16). Then, the triangle ΔYXR and the triangle ΔYX'R are congruent to each other, that is, ΔYXR≡ΔYX'R.

Therefore, the angle ∠XYR becomes identical to the angle ∠X'YR, and thus the direction of the line segment "Y-R" becomes identical to the direction of drive eccentric cam 5 at the working angle center. The term "working angle center" means the center of the entire range of rotation of drive shaft 4.

Next, the eccentric direction of drive eccentric cam 5 at the point of time when the peak lift PL has been reached, is hereunder described or studied in detail.

When the peak lift PL has been reached, the second fulcrum "R" of link arm 16 also reaches an instantaneous point "RP" of the peak lift PL. This instantaneous point "RP" is the point located at the uppermost end of the working locus of the second fulcrum "R". This is because, regarding the linkage attitude at the peak lift PL, the direction of drive eccentric cam 5 and the eccentric direction of link arm 16 become identical to each other, and thus the second fulcrum "R" becomes identical to the instantaneous point "RP" located at the uppermost end of the working locus of the second fulcrum "R". That is, the direction of the line segment "Y-RP" becomes identical to the instantaneous eccentric direction of drive eccentric cam 5 at the peak lift PL.

On the other hand, the working angle center corresponds to the line segment "Y-R" during the minimum working-angle control mode. When viewed in the axial direction defined by the axis of drive shaft 4, the line segment "Y-RP" at the peak lift PL becomes almost aligned with the line segment "Y-R", because of a very small working angle, in other words, the position of the second fulcrum "R" in close proximity to the position of the instantaneous point "RP".

The valve-opening working angle becomes substantially identical to the valve-closing working angle. This is because the angle ∠Y-R-Q (=β) is set to approximately 90 degrees (i.e., ∠Y-R-Q (=β)≈90°).

Exactly speaking, at the peak lift during the minimum working-angle control mode, the angle ∠Y-R-Q (=β) becomes an obtuse angle β1 slightly greater than a right angle (90°). Hence, the valve-opening working angle tends to become slightly less (shorter) than the valve-closing working angle. In the case of the angle ∠Y-R-Q greater than 90 degrees (β>90°), as appreciated from the circular-arc locus of the geometric center "R" (the second fulcrum) shown in FIG. 11, the instantaneous point "RP" tends to geometrically phase-advance with respect to the geometric center "R".

During the minimum working-angle control mode, the valve open period is adequately short and also the valve lift amount is very small. Hence, even when the valve-opening working angle is relatively less (shorter) than the valve-closing working angle, there is a less actual damage to the valve actuation mechanism, because of very small absolute values of driving friction and driving torque. The minimum working-angle control mode is generally used during idling, at no-load running or at light-load running, or at a neutral (N) range of a transmission. That is, the minimum working angle corresponds to a working angle having a high possibility of racing when the transmission is in the N range. A specific lift/working-angle characteristic that a valve-closing working angle is relatively less (shorter) than a valve-opening working angle, is disadvantageous for a high operational guarantee of engine valves. In other words, a specific lift/working-angle characteristic that a valve-closing working angle is equal to or greater (longer) than a valve-opening working angle, is advantageous for a high operational guarantee of engine valves.

[During Middle Working Angle Control Mode]

Thereafter, when the engine operating condition shifts to a middle speed and part-load operating range (i.e., a normal operating range), as shown in FIGS. 6A-6B and 7A-7B, control support shaft 24*a* is rotated to the angular position, corresponding to a rotation angle "θ2" (see FIG. 6A), in the anticlockwise direction by the electric actuator responsively to a control signal from the controller. Therefore, control eccentric shaft 29 is also displaced to a revolution position, corresponding to rotation angle "θ2" (>θ1), such that the fifth fulcrum "Q" (the shaft center of control eccentric shaft 29) approaches closer to drive support shaft 4*a*. As a whole, the attitude of multinodular-link motion transmission mechanism 8, including rocker arm 15, link arm 16, and link rod 17, is displaced in such a manner as to be inclined clockwise with respect to drive support shaft 4*a*, thereby simultaneously causing a change in the attitude of rockable-cam pair 7, 7 to the clockwise direction (in the valve-lifting direction), as appreciated from comparison between the attitude of rockable cam 7 shown in FIG. 4A and the attitude of rockable cam 7 shown in FIG. 6A or from comparison between the attitude of rockable cam 7 shown in FIG. 5A and the attitude of rockable cam 7 shown in FIG. 7A.

Figure 7A:
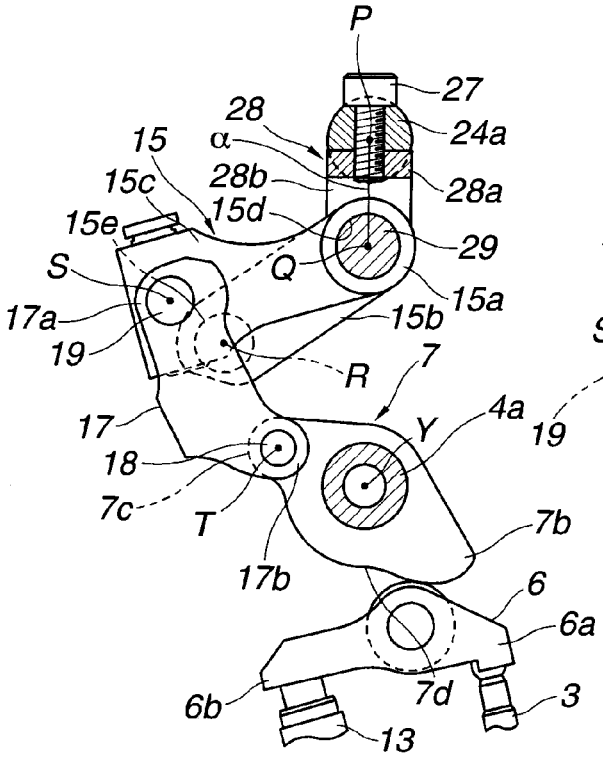
Figure 7B:
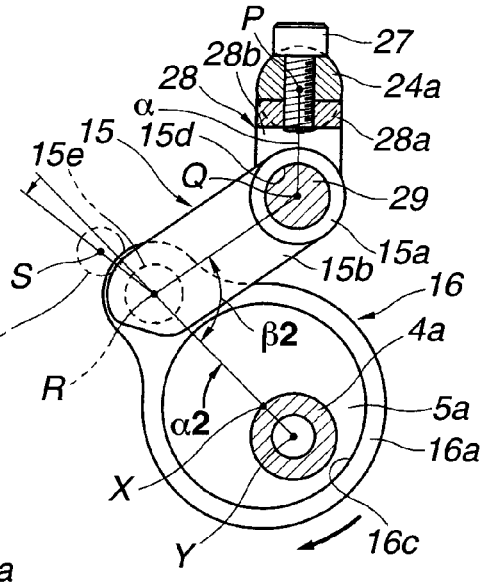
FIG. 7B is a side view of the multinodular-link motion transmission mechanism in partial cross-section taken along the line B-B of FIG. 2 at the peak lift during the valve opening period at the middle working-angle control mode.
Figure 8A:
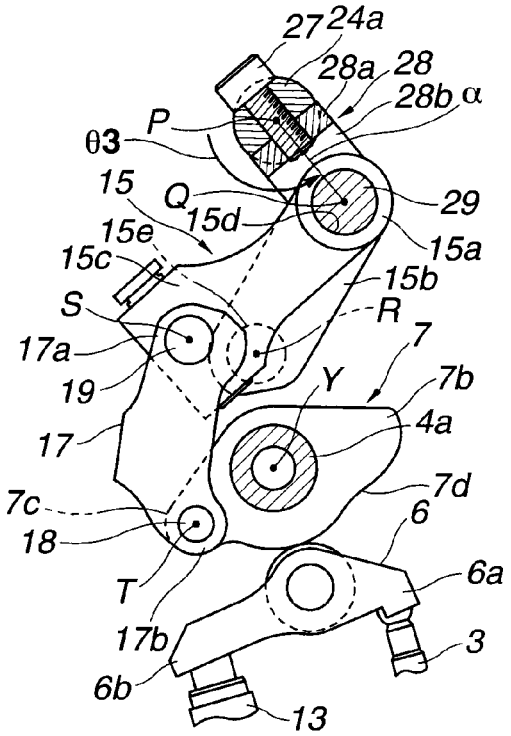
Figure 8B:
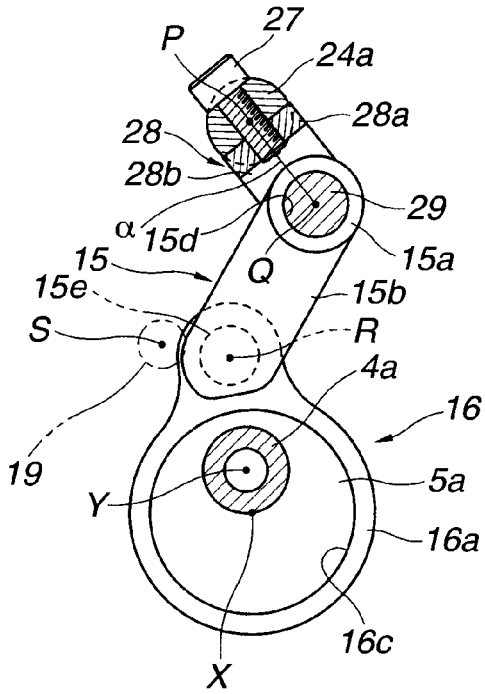
FIG. 8B is a side view of the multinodular-link motion transmission mechanism in partial cross-section taken along the line B-B of FIG. 2 during the valve closing period at the maximum working-angle control mode.

Therefore, as clearly shown in FIGS. 7A-7B, at the peak lift during the valve opening period at the middle working-angle control mode, clockwise rotation of rockable cam 7 (i.e., the valve-lifting motion of rockable cam 7, caused by the displacement of the rolling-contact position of cam contour surface portion 7*d* of rockable cam 7 toward the lift surface) is transmitted via roller 14 of swing arm 6 to the associated intake valve 3 to lift the intake valve. During middle speed and part-load operation, due to the attitude of multinodular-link motion transmission mechanism 8 determined based on rotation angle "θ2", a lift amount and a working angle of intake valve 3 are properly increased to realize a middle lift amount and a middle working angle.

Therefore, as clearly shown in FIG. 10, in a middle speed and part-load range of the engine, a valve lift amount of each of intake valves 3, 3 becomes a middle lift amount L2, and simultaneously the working angle becomes enlarged to a middle working angle.

Figure 5B:
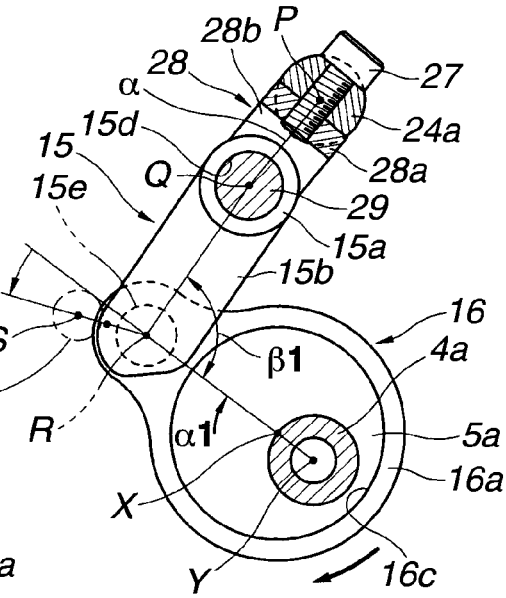
FIG. 5B is a side view of the multinodular-link motion transmission mechanism in partial cross-section taken along the line B-B of FIG. 2 at the peak lift during the valve opening period at the minimum working-angle control mode.
Figure 6A:
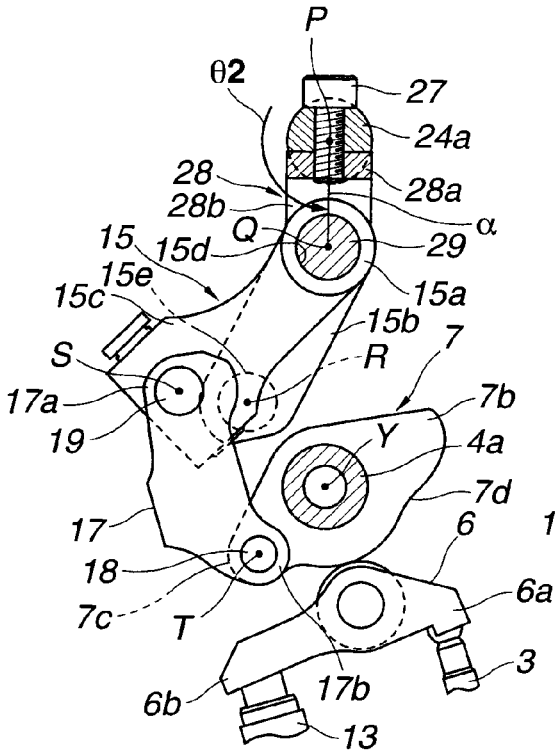
Figure 6B:
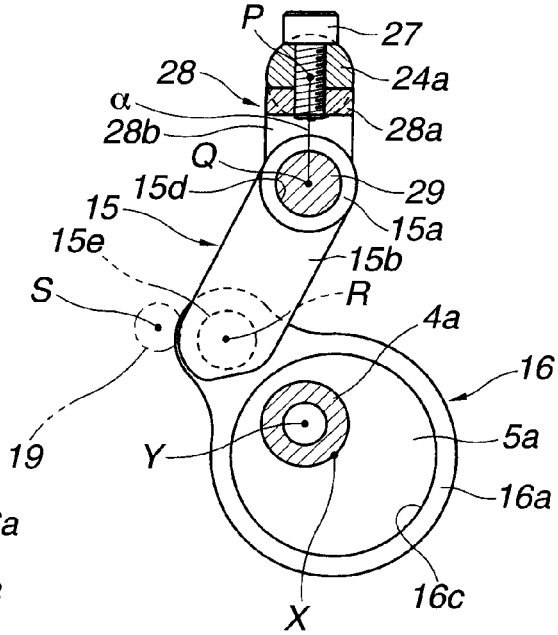
FIG. 6B is a side view of the multinodular-link motion transmission mechanism in partial cross-section taken along the line B-B of FIG. 2 during the valve closing period at the middle working-angle control mode.

When comparing the straight line "Y-X", indicating the eccentric direction of the first fulcrum "X" of drive eccentric cam 5 with respect to the shaft axis "Y" of drive support shaft 4*a* at the peak lift during the valve opening period at the middle working-angle control mode (see FIG. 7B), to the straight line "Y-X", indicating the eccentric direction of the first fulcrum "X" of drive eccentric cam 5 with respect to the shaft axis "Y" of drive support shaft 4*a* at the peak lift during the valve opening period at the minimum working-angle control mode (see FIG. 5B), the eccentric direction "Y-X" of the first fulcrum "X" of drive eccentric cam 5 with respect to the shaft axis "Y" at the middle working-angle control mode (see FIG. 7B) is slightly displaced clockwise from that of the minimum working-angle control mode (see FIG. 5B). That is, as seen in FIG. 7B, the eccentric direction "Y-X" of drive eccentric cam 5 becomes equivalent to an angular position, which has been rotated by an angle "α2" in the rotation direction of drive support shaft 4*a*. The drive-shaft angle "α2" at the middle working-angle control mode (see FIG. 7B) is set to be greater than the drive-shaft angle "α1" at the minimum working-angle control mode (see FIG. 5B), i.e., α2>α1.

Therefore, as seen from the valve lift characteristic diagram of FIG. 10, a phase of the peak lift at the middle working-angle control mode, at which the middle working angle and middle valve lift L2 are produced, retards in comparison with that at the minimum working-angle control mode, at which the minimum working angle and minimum valve lift L1 are produced.

At the middle working-angle control mode, control eccentric shaft 29 is directed to approach closer to drive support shaft 4*a* of drive shaft 4. Thus, at the point of time when the valve lift amount of intake valve 3 reaches its peak lift during the valve opening period (see FIGS. 7A-7B), the angle ∠X-R-Q (=β) between an extension line of a link-arm two-axis line "X-R", which is aligned with the line segment "Y-R", and an extension line of a rocker-arm two-axis line "Q-R" becomes a minimum angle β2, for example, an acute angle less than a right angle (see FIG. 7B), that is, β2<β1. This is because, the line segment "Y-Q" of the triangle ΔYRQ, realized by connecting three noncollinear points, namely, three axes "Y", "R", and "Q", becomes a minimum length, whereas the lengths of line segments "Q-R" and "Y-R" are fixed values.

As appreciated from the arrow (2) of FIG. 10 indicating the difference between the maximum positive valve closing acceleration and the maximum positive valve opening acceleration at the middle working-angle control mode, the maximum positive valve opening acceleration becomes less than the maximum positive valve closing acceleration. As seen from the valve lift characteristic curve at the middle working-angle control mode, the valve-opening lift characteristic curve and the valve-closing lift characteristic curve are unsymmetrical to each other, and the lift characteristic curve is configured as a somewhat backwardly-inclined unsymmetrical lift characteristic. By virtue of the previously-discussed valve acceleration characteristic and backwardly-inclined unsymmetrical lift characteristic obtained at the middle working-angle control mode, it is possible to reduce driving torque as well as driving friction of drive shaft 4, thus achieving enhanced engine startability and improved fuel economy.

Regarding valve movement (valve lifted action), the magnitude of driving torque required for the valve lift increasing side during the valve-opening period, generally, tends to become greater than that required for the valve lift decreasing side during the valve-closing period. This is because driving shaft 4 must be rotated while compressing the valve spring and overcoming mechanical friction between sliding-contact portions, so as to produce driving torque required for valve-opening motion. Conversely, regarding valve lifted action of the valve lift decreasing side, that is, valve-closing motion, the compressive force applied to the valve spring is released and the valve-closing motion is assisted by the spring force of the valve spring, and thus the driving friction is negligible small.

As previously discussed, the lift characteristic curve, obtained at the middle working-angle control mode, is configured as the backwardly-inclined unsymmetrical lift characteristic (see the middle lift characteristic L2 of FIG. 10). Thus, the magnitude of driving torque required for the valve lift increasing side (during the valve-opening period) tends to become small. As is generally known, it is considered that the amount of energy, required for lifting-up action of the engine valve with no frictional resistance, is proportional to the product of the valve-opening driving torque and the valve-opening working angle. In the case of the backwardly-inclined unsymmetrical lift characteristic, the valve-opening working angle becomes relatively greater than the valve-closing working angle and thus the valve-opening driving torque tends to be lowered. As a result of such a lowered valve-opening driving torque, it is possible to reduce the magnitude of load applied to each of component parts constructing the valve actuation mechanism, thus effectively reducing the magnitude of driving friction (including a frictional resistance of sliding-contact portions), in other words, a frictional loss.

As set forth above, by virtue of the backwardly-inclined unsymmetrical lift characteristic curve, obtained at the middle working-angle control mode, it is possible to lower both driving torque and driving friction. When starting in low oil temperature during the engine start-up period, generally, an engine startup torque tends to rise. By the driving-torque/driving-friction reduction effect as previously discussed, it is possible to smoothly start up the engine, thus achieving reduced fuel consumption rate as well as enhanced engine startability.

The mechanism, which realizes the backwardly-inclined unsymmetrical lift characteristic curve and the valve acceleration characteristic, both obtained at the middle working-angle control mode, are hereunder described or studied in detail by reference to FIGS. 6A-6B, 7A-7B, 10, and 12.

Figure 12:
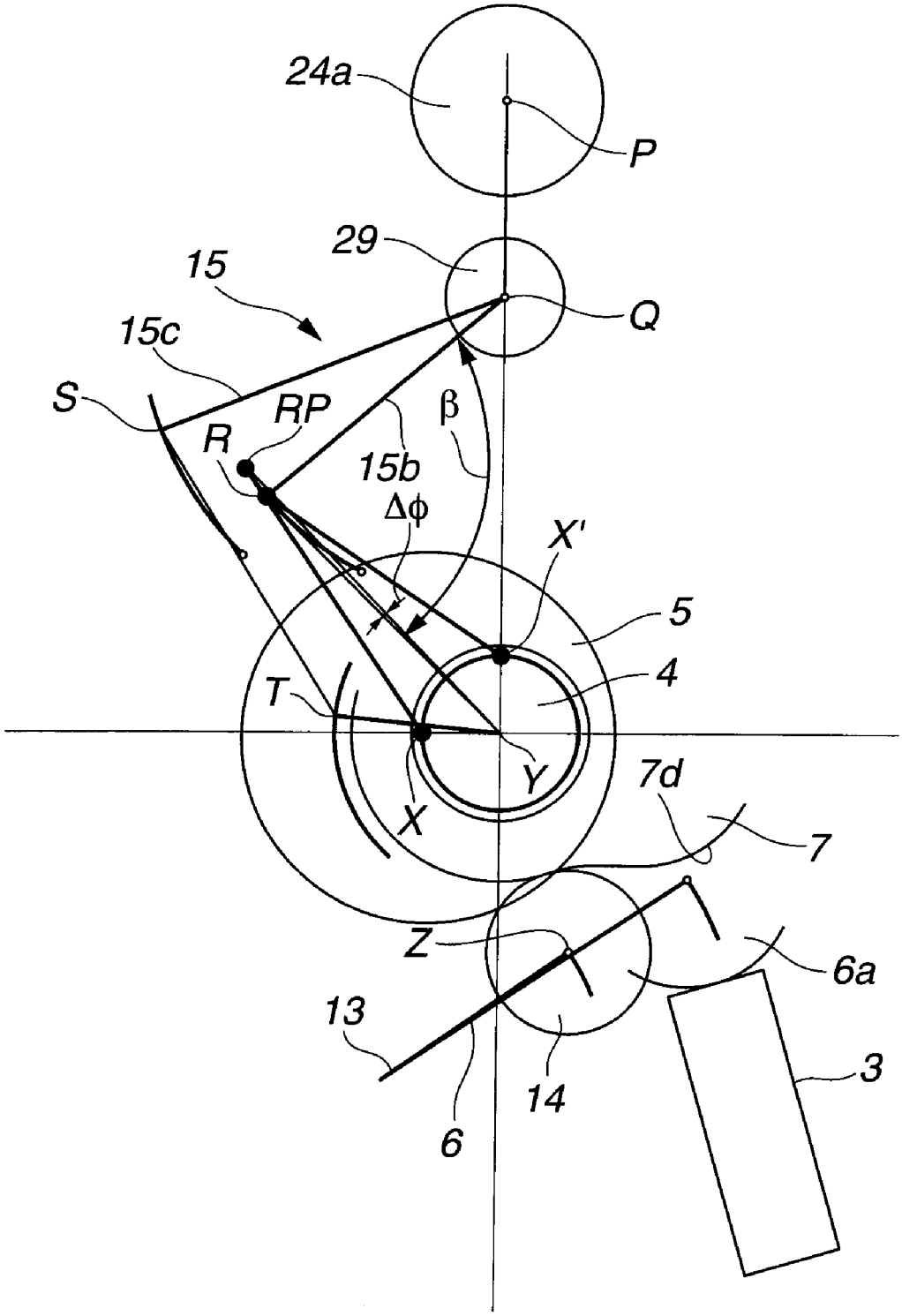
FIG. 12 is a linkage diagram illustrating the operating attitudes of respective moving parts of the multinodular-link motion transmission mechanism of the apparatus of the first embodiment at the middle working-angle control mode.

The positions of the shaft axis (the shaft center) "P" of control support shaft 24*a*, the geometric center "Q" (the fifth fulcrum "Q") of control eccentric shaft 29, the shaft axis (the shaft center) "Y" of drive support shaft 4*a*, and the positions of the pivots, shown in FIG. 12, conform to those shown in FIGS. 6A-6B and 7A-7B. Additionally, the moving points of FIG. 12, namely, the geometric center "R" of rocker arm 15, the geometric center "S" of pivot pin 19, the geometric center "T" of connecting pin 18, and the first fulcrum "X" (i.e., the geometric center "X" of cam body 5*a*), and the geometric center "Z" of roller 14 show their instantaneous positions at the valve-opening working angle starting point, that is, at the starting point of the positive valve opening acceleration, in other words, at a point of the valve-opening ramp lift.

The point "X" shown in FIG. 12 indicates the position of the geometric center of drive eccentric cam 5 at the valve-opening working angle starting point, whereas the connecting point of link arm 16 and rocker arm 15 is the position of the second fulcrum "R" at the valve-opening working angle starting point.

Next, regarding the positions of the geometric center "X" of drive eccentric cam 5 and the second fulcrum "R" at the valve-closing working angle end point, the intake-valve lift (the valve-closing ramp lift) at the working angle end point is set to be identical to the intake-valve lift (the valve-opening ramp lift) at the working angle starting point. Hence, the position of the second fulcrum "R" at the valve-opening working angle starting point becomes substantially identical to the position of the second fulcrum "R" at the valve-closing working angle end point. Assuming that the position of the geometric center of drive eccentric cam 5 at the valve-closing working angle end point is denoted as a point "X'", then the line segment "X'-Y" becomes equal to the line segment "X-Y" (i.e., the eccentricity of drive eccentric cam 5) and the line segment "X'-R" becomes equal to the line segment "X-R" (i.e., the center distance of link arm 16). Then, the triangle ΔYXR and the triangle ΔYX'R are congruent to each other, that is, ΔYXR≡ΔYX'R.

Therefore, the angle ∠XYR becomes identical to the angle ∠X'YR, and thus the direction of the line segment "Y-R" becomes identical to the direction of drive eccentric cam 5 at the working angle center.

Next, the eccentric direction of drive eccentric cam 5 at the point of time when the peak lift PL has been reached, is hereunder described or studied in detail.

When the peak lift PL has been reached, the second fulcrum "R" of link arm 16 also reaches an instantaneous point "RP" of the peak lift PL. This instantaneous point "RP" is the point located at the uppermost end of the working locus (the locus of motion) of the second fulcrum "R". This is because, regarding the linkage attitude at the peak lift PL, the direction of drive eccentric cam 5 and the eccentric direction of link arm 16 become identical to each other, and thus the second fulcrum "R" becomes identical to the instantaneous point "RP" located at the uppermost end of the working locus of the second fulcrum "R". That is, the direction of the line segment "Y-RP" becomes identical to the instantaneous eccentric direction of drive eccentric cam 5 at the peak lift PL.

On the other hand, the working angle center corresponds to the line segment "Y-R" during the middle working-angle control mode. When viewed in the axial direction defined by the axis of drive shaft 4, the line segment "Y-RP" at the peak lift PL becomes slightly retarded by an angle Δϕ with respect to the line segment "Y-R". That is, the valve-opening working angle tends to become slightly greater (longer) than the valve-closing working angle. Therefore, it is possible to provide the superior effects obtained by the backwardly-inclined unsymmetrical lift characteristic curve at the middle working-angle control mode. That is to say, it is possible to enhance the engine startability by lowering the driving torque and also to reduce the fuel consumption rate by lowering the driving friction.

[During Maximum Working Angle Control Mode]

Furthermore, when the engine operating condition shifts from the middle speed and part-load operating range to a high-speed range, as shown in FIGS. 8A-8B and 9A-9B, control support shaft 24*a* is further rotated to the angular position, corresponding to a rotation angle "θ3" (see FIG. 8A), in the anticlockwise direction by the electric actuator responsively to a control signal from the controller. Therefore, control eccentric shaft 29 is also displaced to a revolution position, corresponding to rotation angle "θ3" (>θ2), such that the fifth fulcrum "Q" (the shaft center of control eccentric shaft 29) is displaced to the upper and right position with respect to drive support shaft 4*a* (i.e., on the opposite side of the upper and left position of fifth fulcrum "Q" of control eccentric shaft 29 at the minimum working-angle control mode shown in FIGS. 4A-4B and 5A-5B). As a whole, the attitude of multinodular-link motion transmission mechanism 8 is displaced in such a manner as to be further inclined clockwise (i.e., in the valve-lifting direction) with respect to drive support shaft 4*a*, thereby simultaneously causing a further change in the attitude of rockable-cam pair 7, 7 to the clockwise direction, as appreciated from comparison between the attitude of rockable cam 7 shown in FIG. 6A and the attitude of rockable cam 7 shown in FIG. 8A or from comparison between the attitude of rockable cam 7 shown in FIG. 7A and the attitude of rockable cam 7 shown in FIG. 9A.

Figure 9A:
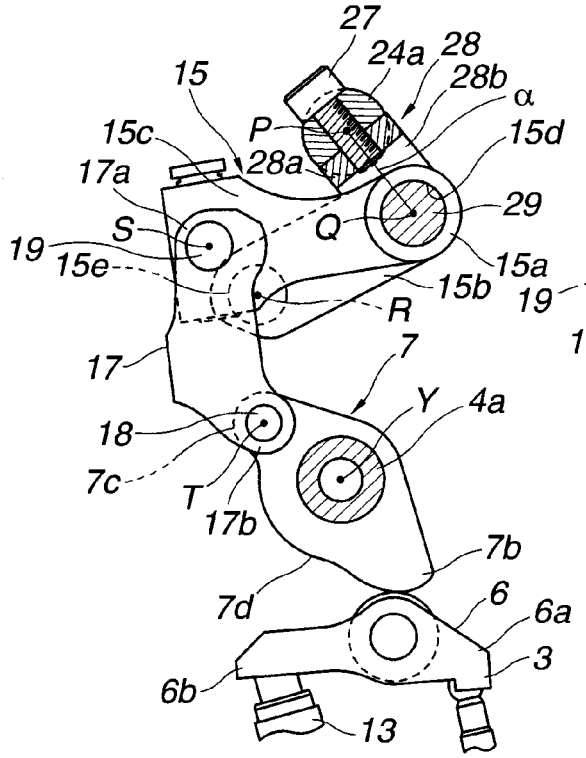
Figure 9B:
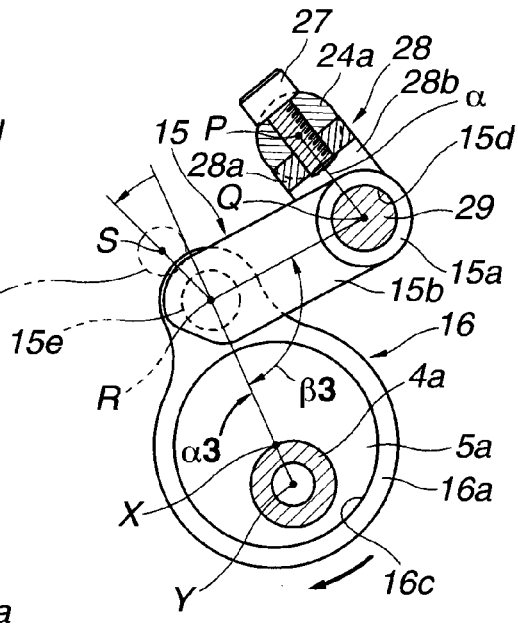
FIG. 9B is a side view of the multinodular-link motion transmission mechanism in partial cross-section taken along the line B-B of FIG. 2 at the peak lift during the valve opening period at the maximum working-angle control mode.

Therefore, as clearly shown in FIGS. 9A-9B, at the peak lift during the valve opening period at the maximum working-angle control mode, clockwise rotation of rockable cam 7 (i.e., the valve-lifting motion of rockable cam 7, caused by the further displacement of the rolling-contact position of cam contour surface portion 7*d* of rockable cam 7 toward the lift surface) is transmitted via roller 14 of swing arm 6 to the associated intake valve 3 to lift the intake valve. During high-speed operation, due to the attitude of multinodular-link motion transmission mechanism 8 determined based on rotation angle "θ3", a lift amount and a working angle of intake valve 3 are properly increased to realize a maximum lift amount and a maximum working angle.

Therefore, as clearly shown in FIG. 10, in a high-speed range, a valve lift amount of each of intake valves 3, 3 becomes a maximum lift amount L3, and simultaneously the working angle becomes enlarged to a maximum working angle. Intake-valve open timing IVO of each of intake valves 3, 3, obtained by the maximum valve lift L3 characteristic at the maximum working-angle control mode, tends to be remarkably phase-advanced from intake-valve open timing IVO, obtained by the minimum valve lift L1 characteristic at the small working-angle control mode. However, notice that, as compared to intake-valve open timing IVO, obtained by the middle valve lift L2 characteristic at the middle working-angle control mode, a degree of phase-advance of intake-valve open timing IVO, obtained by the maximum valve lift L3 characteristic at the large working-angle control mode is properly suppressed. In other words, in the maximum valve lift L3 characteristic at the large working-angle control mode, the overlapping of open periods of intake and exhaust valves is reasonably increased, in comparison with the valve overlap, obtained by the middle valve lift L2 characteristic at the middle working-angle control mode. In contrast with intake-valve open timing IVO, intake-valve closure timing IVC, obtained by the maximum valve lift L3 characteristic at the large working-angle control mode, tends to be adequately phase-retarded from intake-valve closure timing IVC, obtained by the middle valve lift L2 characteristic at the middle working-angle control mode. As a result of the adequately-retarded intake-valve closure timing IVC, it is possible to enhance the charging efficiency of intake air, thus ensuring an adequate engine power output.

When comparing the eccentric direction "Y-X" of the first fulcrum "X" of drive eccentric cam 5 with respect to the shaft axis "Y" of drive support shaft 4*a* at the peak lift during the valve opening period at the maximum working-angle control mode (see FIG. 9B), to the eccentric direction "Y-X" of the first fulcrum "X" of drive eccentric cam 5 with respect to the shaft axis "Y" of drive support shaft 4*a* at the peak lift during the valve opening period at the middle working-angle control mode (see FIG. 7B), the eccentric direction "Y-X" of the first fulcrum "X" of drive eccentric cam 5 with respect to the shaft axis "Y" at the maximum working-angle control mode (see FIG. 9B) is further displaced clockwise from that of the middle working-angle control mode (see FIG. 7B). That is, as seen in FIG. 9B, the eccentric direction "Y-X" of drive eccentric cam 5 becomes equivalent to an angular position, which has been rotated by angle "$\alpha 3$" in the rotation direction of drive support shaft 4*a*. The drive-shaft angle "$\alpha 3$" at the maximum working-angle control mode (see FIG. 9B) is set to be greater than the drive-shaft angle "$\alpha 2$" at the middle working-angle control mode (see FIG. 7B), i.e., $\alpha 3 > \alpha 2$. On the other hand, the angle $\angle$X-R-Q (=$\beta$) between an extension line of link-arm two-axis line "X-R", which is aligned with the line segment "Y-R", and an extension line of rocker-arm two-axis line "Q-R" becomes a larger angle "$\beta 3$" again, that is, $\beta 3 > \beta 2$.

As appreciated from the arrow (1) of FIG. 10 indicating the difference between the maximum positive valve closing acceleration and the maximum positive valve opening acceleration at the maximum working-angle control mode, the maximum positive valve opening acceleration becomes greater than the maximum positive valve closing acceleration. As seen from the valve lift characteristic curve at the maximum working-angle control mode, the valve-opening lift characteristic curve and the valve-closing lift characteristic curve are unsymmetrical to each other, and the lift characteristic curve is configured as a somewhat forwardly-inclined unsymmetrical lift characteristic. By virtue of the previously-discussed valve acceleration characteristic and forwardly-inclined unsymmetrical lift characteristic obtained at the maximum working-angle control mode, it is possible to increase the quantity of intake air, thus increasing engine power output.

As appreciated from the forwardly-inclined unsymmetrical lift characteristic of FIG. 10, obtained at the maximum working-angle control mode, the valve-opening working angle becomes less than the valve-closing working angle. As a result, the positive valve closing acceleration becomes less than the positive valve opening acceleration. This valve acceleration characteristic has an advantage of smooth valve movement. Thus, the engine performance can be improved, especially at high speeds.

That is, in a high engine speed range, after the engine valve (intake valve 3) has passed through its peak lift PL, the engine valve, generally, tends to slightly bounce or jump. In the presence of such a "jumping" or "valve bounce" phenomenon, momentarily, roller 14 of swing arm 6 becomes out of rolling-contact with the cam contour surface of rockable cam 7. After this, owing to return movement of the bounced intake valve 3 to its preferable position by the force of the valve spring, roller 14 is undesirably brought into collision-contact with rockable cam 7. Due to the collision-contact (or impact) arising from the "jumping" or "valve bounce" phenomenon, there is an increased tendency for an abnormally re-seating behavior of intake valve 3 to occur in the last stage of valve-closing motion, thereby causing damage to the valve actuation mechanism, or undesirably reducing the quantity of intake air and consequently lowering the engine power output.

In the case of the variable valve actuation apparatus of the embodiment in which the valve-closing working angle is relatively greater than the valve-opening working angle, the valve lift at the collision point tends to be comparatively high. Hence, roller 14 tends to be brought into collision-contact with rockable cam 7 in a steeply down-sloped valve-closing working angle range (in a steep down-grade valve lift portion), in which the valve-closing velocity difference is still small. The comparatively small valve-closing velocity difference of intake valve 3 at the collision point, suppresses the previously-noted abnormally re-seating behavior of intake valve 3 from occurring in the last stage of valve-closing motion.

In addition to the above, during the maximum working-angle control mode, the maximum positive valve closing acceleration tends to be relatively less than the maximum positive valve opening acceleration (see the arrow (1) of FIG. 10). Hence, the input to the valve actuation mechanism in the last stage of valve-closing motion tends to reduce. This also contributes to a suppression in the abnormally re-seating behavior of intake valve 3.

As discussed above, according to the apparatus of the embodiment, by virtue of the previously-discussed valve acceleration characteristic and forwardly-inclined unsymmetrical lift characteristic obtained at the maximum working-angle control mode, it is possible to reconcile enhanced performance of valve movement and enhanced engine power output in a high engine speed range.

The mechanism, which realizes the forwardly-inclined unsymmetrical lift characteristic curve and the valve acceleration characteristic, both obtained at the maximum working-angle control mode, are hereunder described or studied in detail by reference to FIGS. 8A-8B, 9A-9B, 10, and 13.

Figure 13:
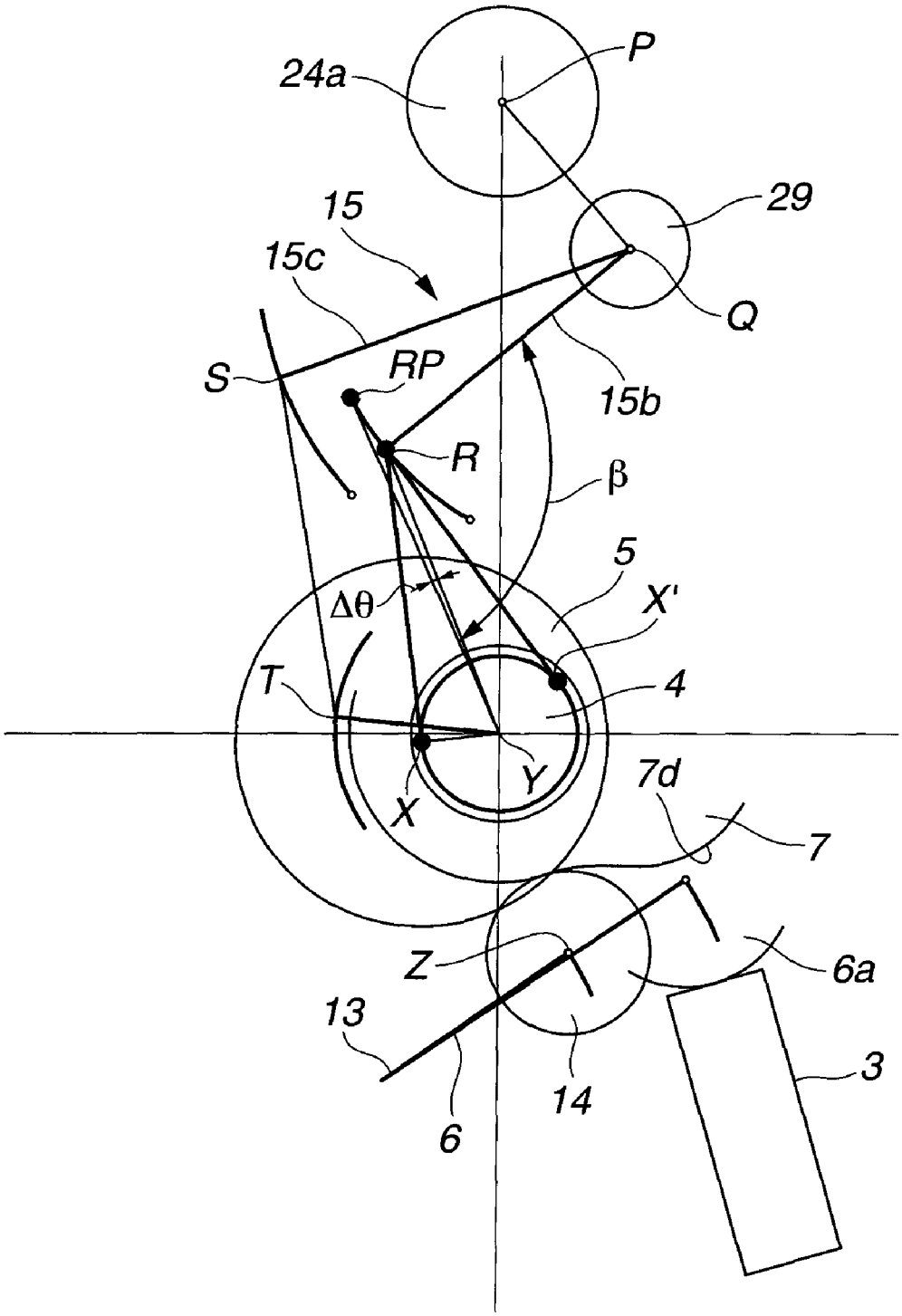
FIG. 13 is a linkage diagram illustrating the operating attitudes of respective moving parts of the multinodular-link motion transmission mechanism of the apparatus of the first embodiment at the maximum working-angle control mode.

The positions of the shaft axis (the shaft center) "P" of control support shaft 24*a*, the geometric center "Q" (the fifth fulcrum "Q") of control eccentric shaft 29, the shaft axis (the shaft center) "Y" of drive support shaft 4*a*, and the positions of the pivots, shown in FIG. 13, conform to those shown in FIGS. 8A-8B and 9A-9B. Additionally, the moving points of FIG. 13, namely, the geometric center "R" of rocker arm 15, the geometric center "S" of pivot pin 19, the geometric center "T" of connecting pin 18, and the first fulcrum "X" (i.e., the geometric center "X" of cam body 5*a*), and the geometric center "Z" of roller 14 show their instantaneous positions at the valve-opening working angle starting point, that is, at the starting point of the positive valve opening acceleration, in other words, at a point of the valve-opening ramp lift.

The point "X" shown in FIG. 13 indicates the position of the geometric center of drive eccentric cam 5 at the valve-opening working angle starting point, whereas the connecting point of link arm 16 and rocker arm 15 is the position of the second fulcrum "R" at the valve-opening working angle starting point.

Next, regarding the positions of the geometric center "X" of drive eccentric cam 5 and the second fulcrum "R" at the valve-closing working angle end point, the intake-valve lift (the valve-closing ramp lift) at the working angle end point is set to be identical to the intake-valve lift (the valve-opening ramp lift) at the working angle starting point. Hence, the position of the second fulcrum "R" at the valve-opening working angle starting point becomes substantially identical to the position of the second fulcrum "R" at the valve-closing working angle end point. Assuming that the position of the geometric center of drive eccentric cam 5 at the valve-closing working angle end point is denoted as a point "X'", then the line segment "X'-Y" becomes equal to the line segment "X-Y" (i.e., the eccentricity of drive eccentric cam 5) and the line segment "X'-R" becomes equal to the line segment "X-R" (i.e., the center distance of link arm 16). Then, the triangle ΔYXR and the triangle ΔYX'R are congruent to each other, that is, ΔYXR≡ΔYX'R.

Therefore, the angle ∠XYR becomes identical to the angle ∠X'YR, and thus the direction of the line segment "Y-R" becomes identical to the direction of drive eccentric cam 5 at the working angle center.

Next, the eccentric direction of drive eccentric cam 5 at the point of time when the peak lift PL has been reached, is hereunder described or studied in detail.

When the peak lift PL has been reached, the second fulcrum "R" of link arm 16 also reaches an instantaneous point "RP" of the peak lift PL. This instantaneous point "RP" is the point located at the uppermost end of the working locus (the locus of motion) of the second fulcrum "R". This is because, regarding the linkage attitude at the peak lift PL, the direction of drive eccentric cam 5 and the eccentric direction of link arm 16 become identical to each other, and thus the second fulcrum "R" becomes identical to the instantaneous point "RP" located at the uppermost end of the working locus of the second fulcrum "R". That is, the direction of the line segment "Y-RP" becomes identical to the instantaneous eccentric direction of drive eccentric cam 5 at the peak lift PL.

On the other hand, the working angle center corresponds to the line segment "Y-R" during the maximum working-angle control mode. When viewed in the axial direction defined by the axis of drive shaft 4, the line segment "Y-RP" at the peak lift PL becomes slightly advanced by an angle Δθ with respect to the line segment "Y-R". That is, the valve-opening working angle tends to become slightly less (shorter) than the valve-closing working angle. Therefore, it is possible to provide the superior effects obtained by the forwardly-inclined unsymmetrical lift characteristic curve at the maximum working-angle control mode. That is to say, it is possible to enhance engine power output and also to enhance or improve valve movement of the valve actuation mechanism in a high engine speed range.

The reason for the phase-advancement of angle Δθ, is that the angle ∠Y-R-Q (=β) becomes a larger angle "β3" again, that is, an obtuse angle β3 greater than a right angle (90°), that is, β3>β2. That is, in the case of the angle β exceeding 90°, as can be seen from the circular-arc locus of the geometric center "R" (the second fulcrum) shown in FIG. 13, the instantaneous point "RP" tends to geometrically phase-advance with respect to the geometric center "R".

Figure 14:
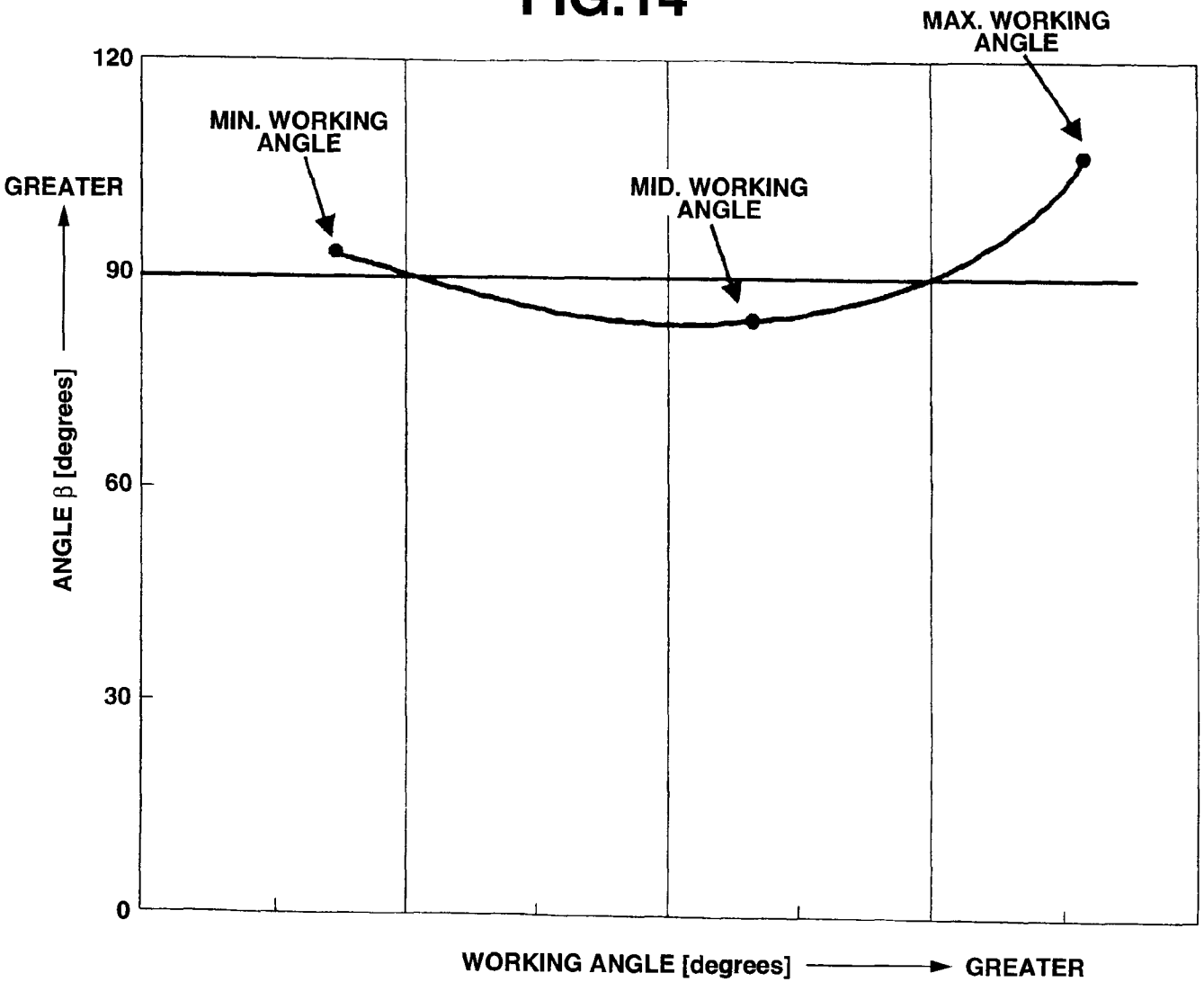
FIG. 14 is a graph illustrating the relationship between an intake-valve working angle in the apparatus of the first embodiment and an angle $\beta$.

The working angle versus angle ∠Y-R-Q (β) characteristic is hereunder described in detail in reference to FIG. 14.

At the minimum working angle, the angle β (=∠Y-R-Q) tends to become slightly greater than a right angle (90°), and thus the valve-closing working angle tends to become slightly greater than the valve-opening working angle, and the positive valve closing acceleration tends to become slightly less than the positive valve opening acceleration.

At the middle working angle, the angle β (=∠Y-R-Q) tends to become less than a right angle (90°), and thus the valve-opening working angle tends to become greater than the valve-closing working angle, and the maximum positive valve opening acceleration tends to become less than the maximum positive valve closing acceleration.

At the maximum working angle, the angle β (=∠Y-R-Q) tends to become greater than a right angle (90°), and thus the valve-opening working angle tends to become less than the valve-closing working angle, and the maximum positive valve opening acceleration tends to become greater than the maximum positive valve closing acceleration.

[Ramp Acceleration]

Next, the ramp acceleration is hereunder described or studied in detail by reference to FIG. 10.

As can be appreciated from the valve acceleration characteristic curves of FIG. 10, at the maximum working-angle control mode, the maximum positive acceleration of the valve-closing ramp section becomes less than the maximum positive acceleration of the valve-opening ramp section, and thus the valve-closing ramp velocity tends to become relatively lower than the valve-opening ramp velocity. This is because the integral of positive accelerations of the ramp section corresponds to the ramp velocity. Hence, at the maximum working-angle control mode, the re-seating velocity that lets the intake valve 3 down onto the valve seat tends to reduce, thereby suppressing the undesirable "valve bounce" phenomenon of intake valve 3 from occurring after re-seated, and consequently suppressing the valve actuation mechanism from being damaged and suppressing the charging efficiency of intake air from being lowered.

In contrast, at the middle working angle, the maximum positive valve-opening ramp acceleration tends to become less than the maximum positive valve-closing ramp acceleration. Thus, it is possible to effectively reduce an impact load input at the valve-opening ramp section. Hence, during the valve lift increasing period (i.e., during the valve-opening period), it is possible to reduce driving torque as well as driving friction of drive shaft 4.

Regarding the maximum valve-opening ramp accelerations respectively obtained at the middle and maximum working angles, the maximum positive valve-opening ramp acceleration obtained at the middle working angle tends to become less than that obtained at the maximum working angle. That is, the apparatus of the first embodiment is configured to achieve a remarkable driving-friction/driving-torque reduction effect at the middle working angle rather than at the maximum working angle.

Conversely, regarding the maximum valve-closing ramp accelerations respectively obtained at the middle and maximum working angles, the maximum positive valve-closing ramp acceleration obtained at the maximum working angle tends to become less than that obtained at the middle working angle. That is, the apparatus of the first embodiment is configured to effectively suppress an abnormally re-seating behavior of intake valve 3 from occurring in the last stage of valve-closing motion especially at the maximum working angle.

Second Embodiment

Figure 15:
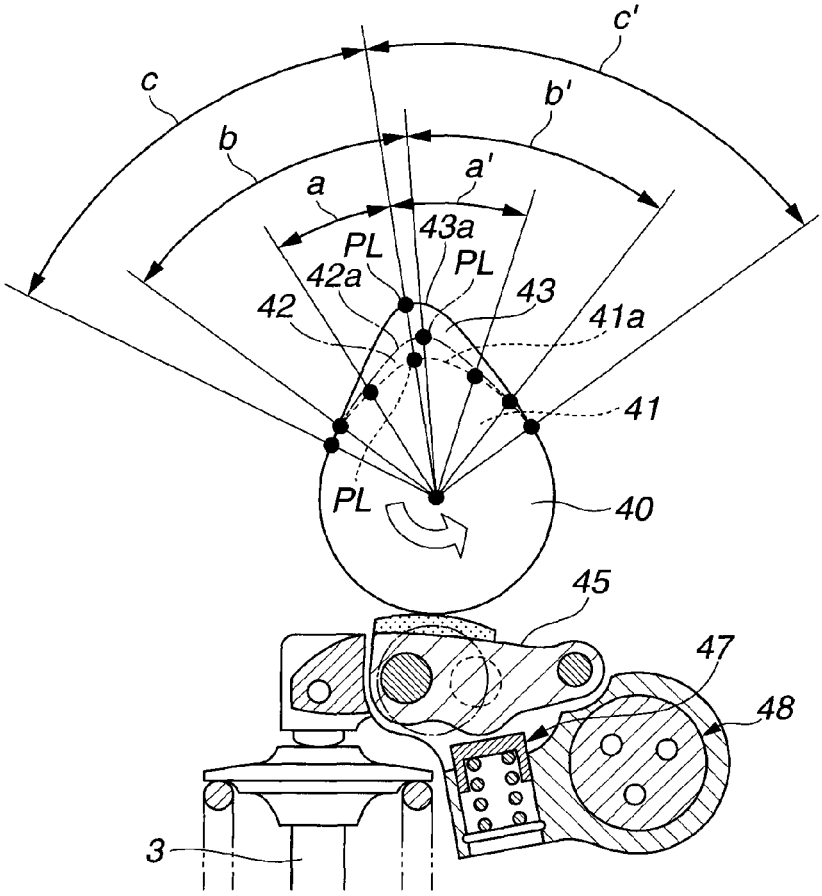
FIG. 15 is a cross-sectional view illustrating the essential part of a variable valve actuation apparatus of the second embodiment, taken along the line C-C of FIG. 16.
Figure 16:
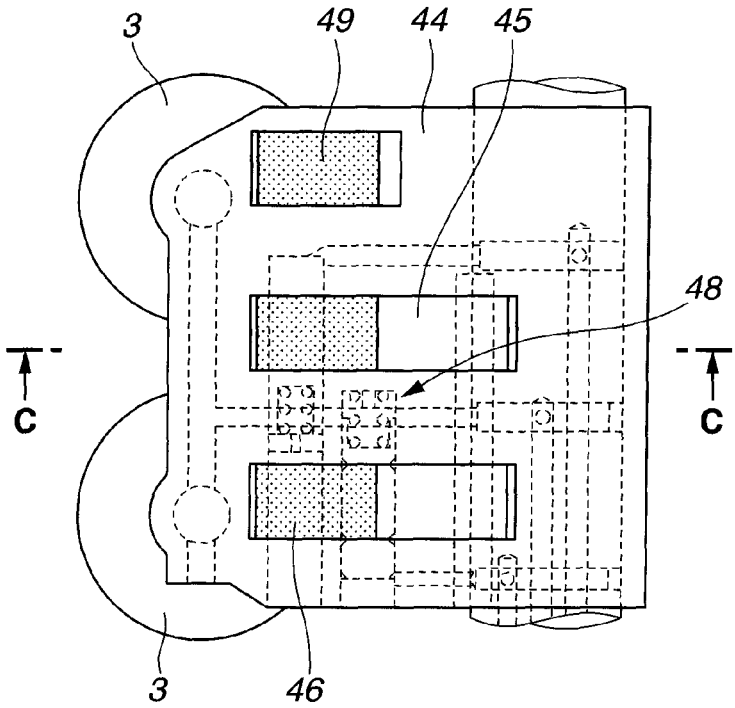
FIG. 16 is a plan view illustrating the variable valve actuation apparatus of the second embodiment.

Referring now to FIGS. 15-16, there is shown the variable valve actuation apparatus of the second embodiment. The fundamental structure of the apparatus of the second embodiment is similar to that of the variable valve actuation apparatus shown in FIGS. 16-17 of JP2002-256832 (corresponding to U.S. Pat. No. 6,550,437), except that three cam profiles of three cams 41-43 of the apparatus of the second embodiment differ from those of the apparatus shown in FIGS. 16-17 of U.S. Pat. No. 6,550,437, issued Apr. 22, 2003 to Nakamura et al., the teachings of which are hereby incorporated by reference.

In the second embodiment, a minimum-working-angle cam 41, a middle-working-angle cam 42, and a maximum-working-angle cam 43 are disposed adjacent to each other and fixed to a camshaft 40 rotated in synchronism with rotation with a crankshaft. Also arranged are a main rocker arm 44 with which minimum-working-angle cam 41 comes into slide contact, and sub-rocker arms 45-46 with which middle-working-angle cam 42 and maximum-working-angle cam 43 come into slide contact, respectively. In a low engine speed range (or in a low-speed and light-load range), sub-rocker arms 45-46 are put in lost motion by a lost-motion mechanism 47. In a mid/high speed range, they are coupled with main rocker arm 44 as required via a switching mechanism 48, so as to carry out switching of cams 41-43 with respect to intake valve 3, achieving variable control of the valve lift amount depending on the engine operating condition, such as engine load and speed.

As shown in FIG. 15, these cams 41-43 are of the raindrop-shaped cam profile (the oval cam profile), and different in size with respective lift portions 41*a*, 42*a*, and 43*a* formed to be smaller in that order and respective ramp portions 41*b*, 42*b*, and 43*b* shaped differently. Especially, the valve-opening working angle and the valve-closing working angle of each of cams 41-43 are configured to differ from each other.

The specific cam profile of minimum-working-angle cam 41 is configured such that the valve-opening working angle "a" becomes less (shorter) than the valve-closing working angle "a'" during operation of intake valve 3. In more detail, the specific cam profile of minimum-working-angle cam 41 is configured to provide a valve lift characteristic, identical to the minimum valve lift L1 characteristic curve, which curve is obtained by the apparatus of the first embodiment during the minimum working-angle control mode.

The specific cam profile of middle-working-angle cam 42 is configured such that the valve-opening working angle "b" becomes greater (longer) than the valve-closing working angle "b'" during operation of intake valve 3. In more detail, the specific cam profile of middle-working-angle cam 42 is configured to provide a valve lift characteristic, identical to the middle valve lift L2 characteristic curve, which curve is obtained by the apparatus of the first embodiment during the middle working-angle control mode.

The specific cam profile of maximum-working-angle cam 43 is configured such that the valve-opening working angle "c" becomes less (shorter) than the valve-closing working angle "c'" during operation of intake valve 3. In more detail, the specific cam profile of maximum-working-angle cam 43 is configured to provide a valve lift characteristic, identical to the maximum valve lift L3 characteristic curve, which curve is obtained by the apparatus of the first embodiment during the maximum working-angle control mode.

Therefore, in the apparatus of the second embodiment, in a low engine speed range, minimum-working-angle cam 41 comes into contact with a slipper follower 49, to rock main rocker arm 44, achieving opening/closing operation of intake valves 3, 3 with the small valve lift L1 characteristic. During this period, middle-working-angle cam 42 and maximum-working-angle cam 43 are both in lost motion.

By virtue of the specific cam profile of minimum-working-angle cam 41 (the specific relationship (i.e., a<a') between valve-opening working angle "a" and valve-closing working angle "a'"), it is possible to ensure the enhanced performance of valve movement of intake valve 3 even with the transmission conditioned in the N range (having a high possibility of racing). As seen in FIG. 15, the peak-lift phase of the minimum-working-angle cam 41 is identical to that of the maximum-working-angle cam 43, but it is possible to achieve the enhanced valve-movement performance by the specific relationship (i.e., a<a').

When shifting to a middle speed range, sub-rocker arm 45 is coupled with main rocker arm 44, such that main rocker arm 44 is driven along the cam profile of middle-working-angle cam 42. Thus, opening/closing operation of intake valves 3, 3 can be achieved in accordance with the middle valve lift L2 characteristic that the valve-opening working angle "b" becomes greater (longer) than the valve-closing working angle "b'". By virtue of the specific cam profile of middle-working-angle cam 42 (the specific relationship (i.e., b>b') between valve-opening working angle "b" and valve-closing working angle "b'"), it is possible to effectively reduce both driving torque and driving friction in a normal engine operating range, thus ensuring the enhanced engine startability.

Thereafter, when further shifting to a high speed range, sub-rocker arm 46 is coupled with main rocker arm 44, such that main rocker arm 44 is driven along the cam profile of maximum-working-angle cam 43. Thus, opening/closing operation of intake valves 3, 3 can be achieved in accordance with the maximum valve lift L3 characteristic that the valve-opening working angle "c" becomes less (shorter) than the valve-closing working angle "c'". By virtue of the specific cam profile of maximum-working-angle cam 43 (the specific relationship (i.e., c<c') between valve-opening working angle "c" and valve-closing working angle "c'"), it is possible to enhance the performance of valve movement in the high speed range, thereby enhancing engine power output.

As set out above, by the provision of three different cams 41-43 having respective specific cam profiles, the apparatus of the second embodiment can provide the same operational effects as the first embodiment.

In the shown embodiment, drive support shaft 4*a*, having a driving connection with drive eccentric cam 5, also serves as a pivot for oscillating motion of rockable cam 7. In lieu thereof, an additional pivot for oscillating motion of rockable cam 7 may be provided separately from drive support shaft 4*a*. Also, drive eccentric cam 5 may be replaced with a general oval-shape cam.

In the shown embodiments, the variable valve actuation apparatus is applied to only the intake-valve side. It will be appreciated that the invention is not limited to the particular embodiments shown and described herein, but that the variable valve actuation apparatus may be applied to the exhaust-valve side or both the intake-valve side and the exhaust-valve side.

The entire contents of Japanese Patent Application No. 2009-012695 (filed Jan. 23, 2009) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve actuation apparatus of an internal combustion engine configured to variably control at least a working angle of an engine valve, comprising:

a device configured to control a valve acceleration characteristic of the engine valve depending on an engine operating condition;

the device configured to bring about a first state where a maximum positive valve-closing acceleration of the engine valve becomes less than a maximum positive valve-opening acceleration of the engine valve, at a maximum working angle; and the device configured so that a second state where the maximum positive valve-opening acceleration of the engine valve becomes less than the maximum positive valve-closing acceleration of the engine valve, exists at a working angle less than the maximum working angle.

2. The variable valve actuation apparatus as claimed in claim 1, wherein:

the device is configured to bring about a state where the maximum positive valve-closing acceleration of the engine valve becomes less than or equal to the maximum positive valve-opening acceleration of the engine valve, at a minimum working angle.

3. The variable valve actuation apparatus as claimed in claim 1, wherein:

the device is configured to continuously decrease the working angle of the engine valve from the maximum working angle; and the device is configured to continuously change both the maximum positive valve-opening acceleration and the maximum positive valve-closing acceleration of the engine valve in accordance with a change in the working angle.

4. The variable valve actuation apparatus as claimed in claim 1, wherein:

a lift characteristic of the engine valve includes a valve-opening ramp section in an initial stage of valve-opening motion of the engine valve and a valve-closing ramp section in a last stage of valve-closing motion of the engine valve;

the device is configured to bring about a third state where the maximum positive valve-closing acceleration of the engine valve in the valve-closing ramp section becomes less than the maximum positive valve-opening acceleration of the engine valve in the valve-opening ramp section, at the maximum working angle; and the device is configured so that a fourth state where the maximum positive valve-opening acceleration of the engine valve in the valve-opening ramp section becomes less than the maximum positive valve-closing acceleration of the engine valve in the valve-closing ramp section, exists at a working angle less than the maximum working angle.

5. The variable valve actuation apparatus as claimed in claim 4, wherein:

the maximum positive valve-opening acceleration of the engine valve in the valve-opening ramp section, produced in the fourth state, becomes less than the maximum positive valve-opening acceleration of the engine valve in the valve-opening ramp section, produced in the third state; and the maximum positive valve-closing acceleration of the engine valve in the valve-closing ramp section, produced in the third state, becomes less than the maximum positive valve-closing acceleration of the engine valve in the valve-closing ramp section, produced in the fourth state.

6. The variable valve actuation apparatus as claimed in claim 1, wherein:

the working angle increases, as an engine speed increases.

7. A variable valve actuation apparatus of an internal combustion engine configured to variably control at least a working angle of an engine valve, comprising:

a device configured to control a lift characteristic of the engine valve depending on an engine operating condition;

the device configured to bring about a fifth state where a valve-closing working angle after a peak lift of a cam lift curve of a cam provided for operating the engine valve becomes greater than a valve-opening working angle before the peak lift of the cam lift curve, at a maximum working angle; and the device configured so that a sixth state where the valve-opening working angle of the cam lift curve becomes greater than the valve-closing working angle of the cam lift curve, exists at a working angle less than the maximum working angle.

8. The variable valve actuation apparatus as claimed in claim 7, wherein:

the device is configured to bring about a state where the valve-opening working angle of the cam lift curve becomes less than or equal to the valve-closing working angle of the cam lift curve, at a minimum working angle.

9. The variable valve actuation apparatus as claimed in claim 7, wherein:

the device is configured to continuously decrease the working angle of the engine valve from the maximum working angle; and the device is configured to continuously change both the valve-opening working angle and the valve-closing working angle of the cam lift curve in accordance with a change in the working angle.

10. The variable valve actuation apparatus as claimed in claim 7, wherein:

the working angle increases, as an engine speed increases.

11. A variable valve actuation apparatus of an internal combustion engine configured to variably control at least a working angle of an engine valve, comprising:

a multinodular-link mechanism comprising:

(a) a drive cam adapted to be mechanically linked to an engine crankshaft, so that torque from the crankshaft is transmitted to the drive cam;

(b) a control shaft having a control eccentric shaft whose geometric center is varied by rotating the control shaft;

(c) a rocker arm adapted to be pivotably supported on the control eccentric shaft;

(d) a link arm adapted to be pivotably supported on the drive cam and linked to the rocker arm, for converting rotary motion of the drive cam into oscillating motion of the rocker arm; and (e) a rockable cam adapted to be linked to the rocker arm, for actuating the engine valve by transmitting an oscillating force of the rocker arm to the rockable cam;

the multinodular-link mechanism configured to change the working angle of the engine valve by rotating the control shaft;

the multinodular-link mechanism configured to produce a linkage attitude change that an angle between a first line segment interconnecting a rotation center of the drive cam and a connecting point of the link arm and the rocker arm and a second line segment interconnecting the connecting point of the link arm and the rocker arm and a geometric center of the control eccentric shaft becomes greater than 90 degrees at either a valve-opening working angle starting point or a valve-closing working angle end point under a state where the control shaft has been rotated to change the working angle of the engine valve to a maximum working angle; and the multinodular-link mechanism configured to produce a linkage attitude change that the angle between the first line segment and the second line segment becomes less than 90 degrees at either the valve-opening working angle starting point or the valve-closing working angle end point under a state where the control shaft has been rotated in a direction for decreasing of the working angle of the engine valve from the maximum working angle.

12. The variable valve actuation apparatus as claimed in claim 11, wherein:

the link arm and the rocker arm are pivotably linked to each other.

13. The variable valve actuation apparatus as claimed in claim 11, which further comprises:

a link rod via which the oscillating force of the rocker arm is transmitted to the rockable cam, for creating oscillating motion of the rockable cam.

14. The variable valve actuation apparatus as claimed in claim 13, wherein:

the link rod is linked to both the rocker arm and the rockable cam to permit the rocker arm and the rockable cam to be pivotably linked to each other.

15. The variable valve actuation apparatus as claimed in claim 14, wherein:

the rockable cam is configured to oscillate in a direction for opening of the engine valve each time one end of the rockable cam is pulled up by the link rod.

16. The variable valve actuation apparatus as claimed in claim 13, wherein:

a first oscillating force transmission portion provided for transmitting an oscillating force from the link arm to the rocker arm and a second oscillating force transmission portion provided for transmitting an oscillating force from the rocker arm to the link rod, are laid out on the same side with respect to the geometric center of the control eccentric shaft corresponding to a fulcrum of oscillating motion of the rocker arm.

17. The variable valve actuation apparatus as claimed in claim 11, wherein:

the control shaft comprises:

(a) a rotary shaft being circle in cross section and having a rotation axis; and (b) the control eccentric shaft whose geometric center is displaced from the rotation axis of the rotary shaft.

18. A variable valve actuation apparatus of an internal combustion engine configured to variably control at least a working angle of an engine valve, comprising:

a multiple-cam valve actuation mechanism comprising:

(a) a plurality of cams having respective specific cam profiles differing from each other; and (b) a switching mechanism configured to carry out switching of the cams with respect to the engine valve, for changing the working angle of the engine valve by the specific cam profile of a selected one of the cams, wherein a maximum-working-angle cam of the cams is configured to produce a maximum working angle and has the specific cam profile that an inclination angle of a former-half maximum-working-angle cam-contour surface section, ranging from a first base-circle surface to a first lift surface to produce opening-motion of the engine valve, is set to be greater than an inclination angle of a latter-half maximum-working-angle cam-contour surface section, ranging from the first lift surface to the first base-circle surface to produce closing-motion of the engine valve, and wherein at least one of the cams except the maximum-working-angle cam is configured to produce a relatively small working angle less than the maximum working angle and has the specific cam profile that an inclination angle of a former-half relatively-small-working-angle cam-contour surface section, ranging from a second base-circle surface to a second lift surface to produce opening-motion of the engine valve, is set to be less than an inclination angle of a latter-half relatively-small-working-angle cam-contour surface section, ranging from the second lift surface to the second base-circle surface to produce closing-motion of the engine valve.

19. The variable valve actuation apparatus as claimed in claim 18, wherein:

the plurality of cams comprise three cams having respective working-angle characteristics differing from each other;

a minimum-working-angle cam of the cams is configured to produce a minimum working angle and has the specific cam profile that an inclination angle of a former-half minimum-working-angle cam-contour surface section, ranging from a third base-circle surface to a third lift surface to produce opening-motion of the engine valve, is set to be greater than or equal to an inclination angle of a latter-half minimum-working-angle cam-contour surface section, ranging from the third lift surface to the third base-circle surface to produce closing-motion of the engine valve;

the maximum-working-angle cam of the cams is configured to produce the maximum working angle and has the specific cam profile that the inclination angle of the former-half maximum-working-angle cam-contour surface section, ranging from the first base-circle surface to the first lift surface to produce opening-motion of the engine valve, is set to be greater than the inclination angle of the latter-half maximum-working-angle cam-contour surface section, ranging from the first lift surface to the first base-circle surface to produce closing-motion of the engine valve; and a middle-working-angle cam of the cams is configured to produce a middle working angle between the maximum working angle and the minimum working angle and has the specific cam profile that an inclination angle of a former-half middle-working-angle cam-contour surface section, ranging from a fourth base-circle surface to a fourth lift surface to produce opening-motion of the engine valve, is set to be less than an inclination angle of a latter-half middle-working-angle cam-contour surface section, ranging from the fourth lift surface to the fourth base-circle surface to produce closing-motion of the engine valve.

20. The variable valve actuation apparatus as claimed in claim 18, wherein:

the switching mechanism is further configured to carry out switching of the cams depending on an engine load.

* * * * *